US008366232B2

(12) United States Patent
Sakai

(10) Patent No.: US 8,366,232 B2
(45) **Date of Patent: *Feb. 5, 2013**

(54) METHOD OF MEASURING LANDED DOT, MEASURING APPARATUS FOR LANDED DOT, LIQUID DROPLET EJECTION APPARATUS, METHOD OF MANUFACTURING ELECTRO-OPTIC APPARATUS, ELECTRO-OPTIC APPARATUS, AND ELECTRONIC APPARATUS

(75) Inventor: Hirofumi Sakai, Tsu (JP)

(73) Assignee: Seiko Epson Corporation (JP)

( * ) Notice: Subject to any disclaimer, the term of this patent is extended or adjusted under 35 U.S.C. 154(b) by 1402 days.

This patent is subject to a terminal disclaimer.

(21) Appl. No.: 12/012,765

(22) Filed: Feb. 5, 2008

(65) Prior Publication Data

US 2008/0204502 A1 Aug. 28, 2008

(30) Foreign Application Priority Data

Feb. 26, 2007 (JP) ..... 2007-045743

(51) Int. Cl.
*B41J 29/393* (2006.01)

(52) U.S. Cl. ..... 347/19; 73/865.8; 356/511

(58) Field of Classification Search ..... None
See application file for complete search history.

(56) References Cited

U.S. PATENT DOCUMENTS

| | | | | |
|---|---|---|---|---|
| 2004/0056915 | A1 | 3/2004 | Miyazawa | |
| 2005/0122363 | A1* | 6/2005 | Koyama | 347/19 |
| 2008/0204502 | A1 | 8/2008 | Sakai | |
| 2009/0191326 | A1 | 7/2009 | Ishizuka et al. | |

FOREIGN PATENT DOCUMENTS

| | | |
|---|---|---|
| JP | 2000-121323 | 4/2000 |
| JP | 2004-71222 | 3/2004 |
| JP | 2005-119139 | 5/2005 |
| JP | 2005-121401 | 5/2005 |
| JP | 2005-339816 | 12/2005 |
| JP | 2006-136836 | 6/2006 |

OTHER PUBLICATIONS

Derwent Abstract of JP 2006-136836 A.*
Translation of JP 2006-136836 A. (JP 2006-136836 A was published on Jun. 1, 2006.).*

* cited by examiner

*Primary Examiner* — Matthew Luu
*Assistant Examiner* — Justin Seo
(74) *Attorney, Agent, or Firm* — Harness, Dickey & Pierce, P.L.C.

(57) ABSTRACT

A landed dot measuring method in which a topology measuring apparatus having an interferometer measures topology of a landed dot which is a functional liquid droplet landed on an inspection sheet when an inspection ejection for a functional liquid droplet ejection head is performed including: inspection-ejecting in which multiple ejection nozzles of a functional liquid droplet ejection head inspection-eject one by one at a time interval while the functional liquid droplet ejection head is moved in a main scanning direction relatively with respect to the inspection sheet and; and measuring in which respective topologies of multiple landed dots are measured while the topology measuring apparatus follows the functional liquid droplet ejection head and moves in the main scanning direction at a same speed as the functional liquid droplet ejection head relatively with respect to the inspection sheet.

12 Claims, 28 Drawing Sheets

X-AXIS DIRECTION →

STRIPE

MOSAIC

DELTA

METHOD OF MEASURING LANDED DOT, MEASURING APPARATUS FOR LANDED DOT, LIQUID DROPLET EJECTION APPARATUS, METHOD OF MANUFACTURING ELECTRO-OPTIC APPARATUS, ELECTRO-OPTIC APPARATUS, AND ELECTRONIC APPARATUS

The entire disclosure of Japanese Patent Application No. 2007-045743, filed Feb. 26, 2007, is expressly incorporated by reference herein.

BACKGROUND

1. Technical Field

The present invention relates to a method of measuring a landed dot, a measuring apparatus for the landed dot, in which topology thereof which is a functional liquid droplet landed on an inspection sheet from a functional liquid droplet ejection head at the time of an inspection ejection is measured by a topology measuring apparatus, a liquid droplet ejection apparatus, a method of manufacturing electro-optic apparatus, an electro-optic apparatus, and an electronic apparatus.

2. Related Art

Conventionally, as this kind of a method of measuring a landed dot, there is known a method in which liquid droplets are ejected from respective ejection nozzles of a functional liquid droplet ejection head (a liquid droplet ejection head) on a receiving object for measurement, a topology measuring apparatus is moved in an X and a Y directions, and landed dots from respective ejection nozzles which landed on a workpiece are measured one by one. JP-A-2005-121401 is an example of related art. In this case, the topology measuring apparatus obtains data from a CCD camera and a laser type distance measuring apparatus which are faced to the landed dots from the above, calculates and measures volume thereof based on the data.

However, with the method of measuring a landed dot described above, after all of the inspection ejections are completed, respective landed dots are measured. Therefore, time frames of the respective dots are not the same, that is, the respective time frames are different. When the time frames from landing to measuring regarding respective dots are different, topologies (volumes) of the landed dots vary because of evaporation of solvent in each of the landed dots, causing to an inaccuracy of measuring result. Therefore, relative measurement of a landed dot with respect to each of the nozzles and an accurate measurement can not be performed. For example, there are two normal ejection nozzles and they eject liquid droplets at the same time. Volume of one landed dot which is to be measured firstly is measured heavier than that of the other landed dot which is to be measured secondly, because the former has a shorter time frame from landing to measurement than that of the latter and has a less evaporation amount than that of the latter. In other words, As the other landed dot which is to be measured secondly has a longer time frame from landing to measurement, leading to a more evaporation amount, the volume thereof is measured less. Therefore, a reference level of a landed dot from the normal ejection nozzle is not stable, or the volume of a landed dot is offset from the reference level even ejected from the normal ejection nozzle, making it impossible to measure correctly.

SUMMARY

An advantage of some aspects of the invention is to provide a method of measuring a landed dot, a landed dot measuring apparatus which can measure the landed dot correctly, accurately and efficiently, a liquid droplet ejection apparatus, a method of manufacturing an electro-optic apparatus, an electro-optic apparatus, and an electronic apparatus.

According to one aspect of the invention, there is provided a landed dot measuring method in which a topology measuring apparatus having an interferometer measures topology of a landed dot which is a functional liquid droplet landed on an inspection sheet when an inspection ejection for a functional liquid droplet ejection head is performed including: inspection-ejecting in which multiple ejection nozzles of a functional liquid droplet ejection head inspection-eject one by one at a time interval while the functional liquid droplet ejection head is moved in a main scanning direction relatively with respect to the inspection sheet and; and measuring in which respective topologies of multiple landed dots are measured while the topology measuring apparatus follows the functional liquid droplet ejection head and moves in the main scanning direction at a same speed as the functional liquid droplet ejection head relatively with respect to the inspection sheet.

According to another aspect of the invention, there is provided a landed dot measuring apparatus in which a topology measuring apparatus having an interferometer measures topology of a landed dot which is a functional liquid droplet landed on an inspection sheet when an inspection ejection for a functional liquid droplet ejection head is performed comprising: a head moving device which moves a functional liquid droplet ejection head in a main scanning direction relatively with respect to the inspection sheet; the topology measuring apparatus which measures topology of the landed dot; a moving device for the topology measuring apparatus which moves the topology measuring apparatus in the main scanning direction and a sub scanning direction relatively with respect to the inspection sheet; and a controller which controls the functional liquid droplet ejection head, the head moving device, the topology measuring apparatus and the moving device for the topology measuring apparatus, the controller causing multiple ejection nozzles of the functional liquid droplet ejection head to inspection-eject one by one at a time interval while moving the functional liquid droplet ejection head in the main scanning direction relatively, and measuring topologies of multiple landed dots while moving the topology measuring apparatus so as to follow the functional liquid droplet ejection head by relative movements in the main scanning direction and the sub scanning direction at a same speed as the functional liquid droplet ejection head.

According to these configurations, it is possible to make time frames the same from ejection from each of the ejection nozzles to measurement, thereby making time frames the same from landing to measurement per landed dot. Therefore, an influence of evaporation or the like does not affect to each of the landed dots and relative measurements can be performed for the landed dot from each of the ejection nozzles, leading to an accurate measurement. Also, it is possible to measure the landing of each of the landed dots in a short time and effectively by measuring while moving the functional liquid droplet ejection head relatively with respect to the inspection sheet, causing multiple ejection nozzles to inspection ejecting one by one at a time interval, and causing the topology measuring apparatus to follow the functional liquid droplet ejection head at a same speed as the functional liquid droplet ejection head. Note that a landed dot may comprises one shot or a several shots.

It is preferable, in the landed dot measuring method described above, that it further includes volume measuring which measures volume of each of the landed dots based on a result of a topology measurement.

It is preferable, in the landed dot measuring apparatus described above, that the topology measuring apparatus measures volume of each of the landed dots based on the result of the topology measurement.

According to these configurations, it is possible to measure accurate volume of each of the landed dots based on an accurate result of the topology measurement.

It is preferable, in the landed dot measuring method described above, that it further includes position measuring which measures a positional offset amount from a designed value of each of the landed dots based on the result of the topology measurement.

It is preferable, in the landed dot measuring apparatus described above, that the topology measuring apparatus measures a positional offset amount from a designed value of each of the landed dots based on the result of the topology measurement.

According to these configurations, it is possible to obtain the positional offset amount for a landing position of each of the landed dots by using the topology measuring apparatus, in addition to the accurate topology measurement for each of the landed dots. It is also possible to measure a flight deflection and the like of the functional liquid droplet ejection head, not to mention to detect an improper ejection.

According to another aspect of the invention, there is provided a liquid droplet ejection apparatus comprising: a landed dot measuring apparatus described above; a head unit having a sub carriage in which a plurality of the functional liquid droplet ejection heads is mounted; and a plotting device which plots by ejecting functional liquid droplets from the plurality of the functional liquid droplet ejection heads while moving the head unit relatively with respect to a workpiece.

According to this configuration, it is possible to plot in a high precision manner all the time without line unevenness or the like, because a proper maintenance for a plurality of functional liquid droplet ejection heads can be performed by having the landed dot measuring apparatus which can measure the topology of the landed dot accurately.

In this case, it is preferred that the head unit has a functional liquid droplet ejection head introducing a functional liquid of R color, a functional liquid droplet ejection head introducing a functional liquid of G color, and a functional liquid droplet ejection head introducing a functional liquid of B color.

According to this configuration, it is possible to manufacture a color filter of which a pixel region is landed by three colors of the functional liquids. It is also possible to manufacture a color filter without color heterogeneity and color mixture by the above mentioned topology measuring apparatus for the landed dot, thereby enhancing a reliability of the apparatus.

According to another aspect of the invention, there is provided a method of manufacturing an electro-optical apparatus wherein a film portion is formed with a functional liquid droplet on a workpiece using the liquid droplet ejection apparatus described above.

According to another aspect of the invention, there is provided an electro-optical apparatus wherein a film portion is formed with a functional liquid droplet on a workpiece using the liquid droplet ejection apparatus described above.

According to this configuration, it is possible to manufacture electro-optical apparatuses with high quality. Note that examples of the functional materials are: a light emitting material (a luminescent layer, a positive-hole injection layer) of an organic EL (Electro-Luminescence) apparatus, a filter material (a filter element) of the color filter used in a liquid crystal display apparatus, a fluorescent material (a fluorescent element) of an electron ejection apparatus (a Field Emission Display: FED), a fluorescent material (a fluorescent element of a PDP (a Plasma Display Panel) apparatus, and an electrophoresis element material (an electrophoresis element) of an electrophoresis display apparatus, etc. They are liquid materials capable of being ejected from a functional liquid droplet ejection head (an ink jet head). Also, there are the organic EL apparatus, the liquid crystal display apparatus, the electron ejection apparatus, the PDP apparatus, and the electrophoresis display apparatus, etc., as the electro-optical apparatus (the Flat Panel Display: FPD).

According to the other aspect of the invention, there is provided an electronic apparatus having the electro-optical apparatus manufactured by the method of the electro-optical apparatus described above or the electro-optical apparatus described above.

In this case, the electronic apparatus is directed to a cellular phone, a personal computer, and various electronic apparatuses on which a so-called flat panel display is mounted.

DESCRIPTION OF EXEMPLARY EMBODIMENTS

An embodiment of the present invention will be described hereinafter with reference to the accompanying drawings. A liquid droplet ejection apparatus according to this embodiment is used in a production line of a flat panel display device. For example, the liquid droplet ejection apparatus employs functional liquid droplet ejection heads using special ink or functional liquid such as luminescent resin liquid to form light-emitting elements serving as pixels of a color filter of a liquid crystal display device or an organic EL device.

Figure 1:
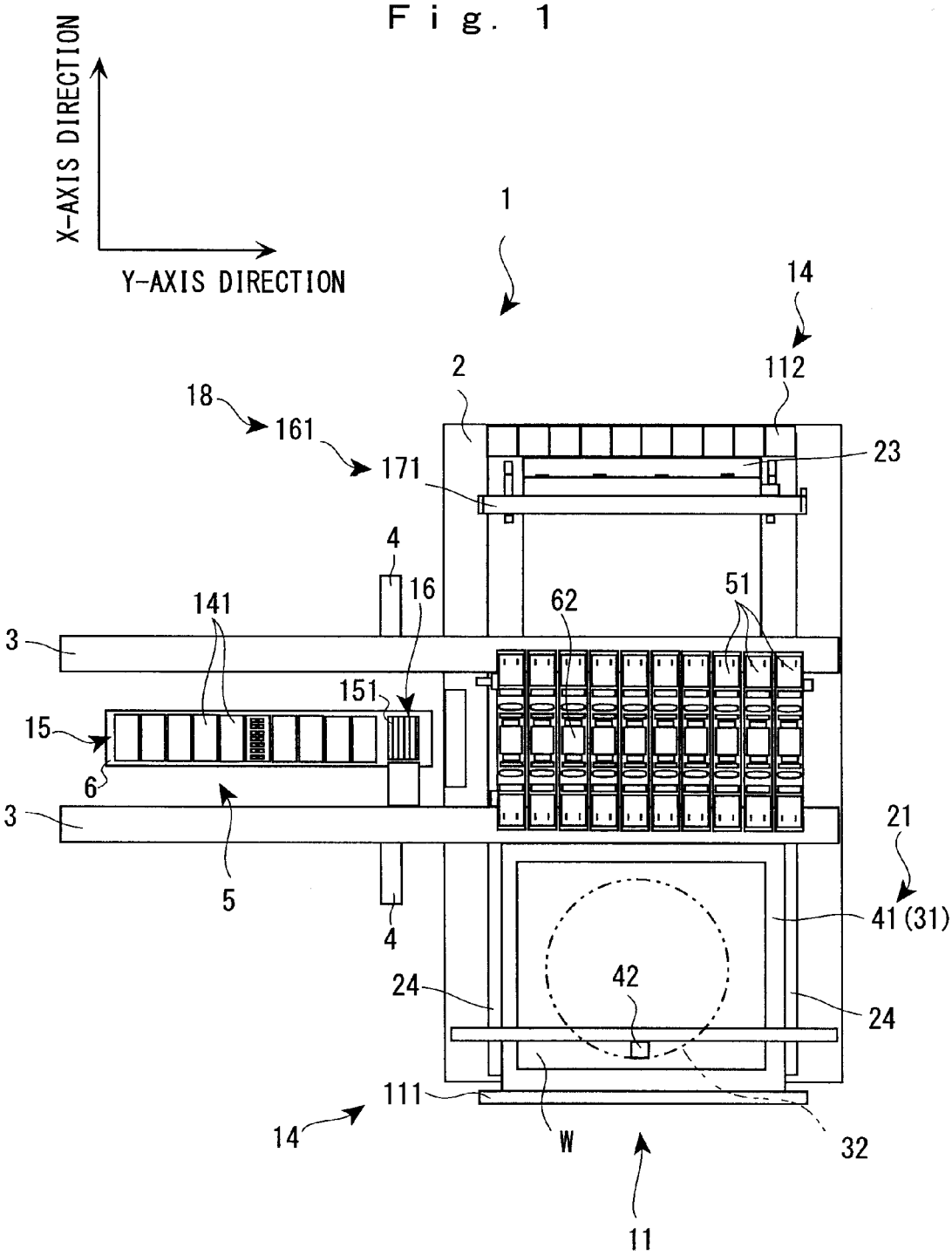
FIG. 1 is a plan view of a liquid droplet ejection apparatus according to an embodiment of the invention.
Figure 2:
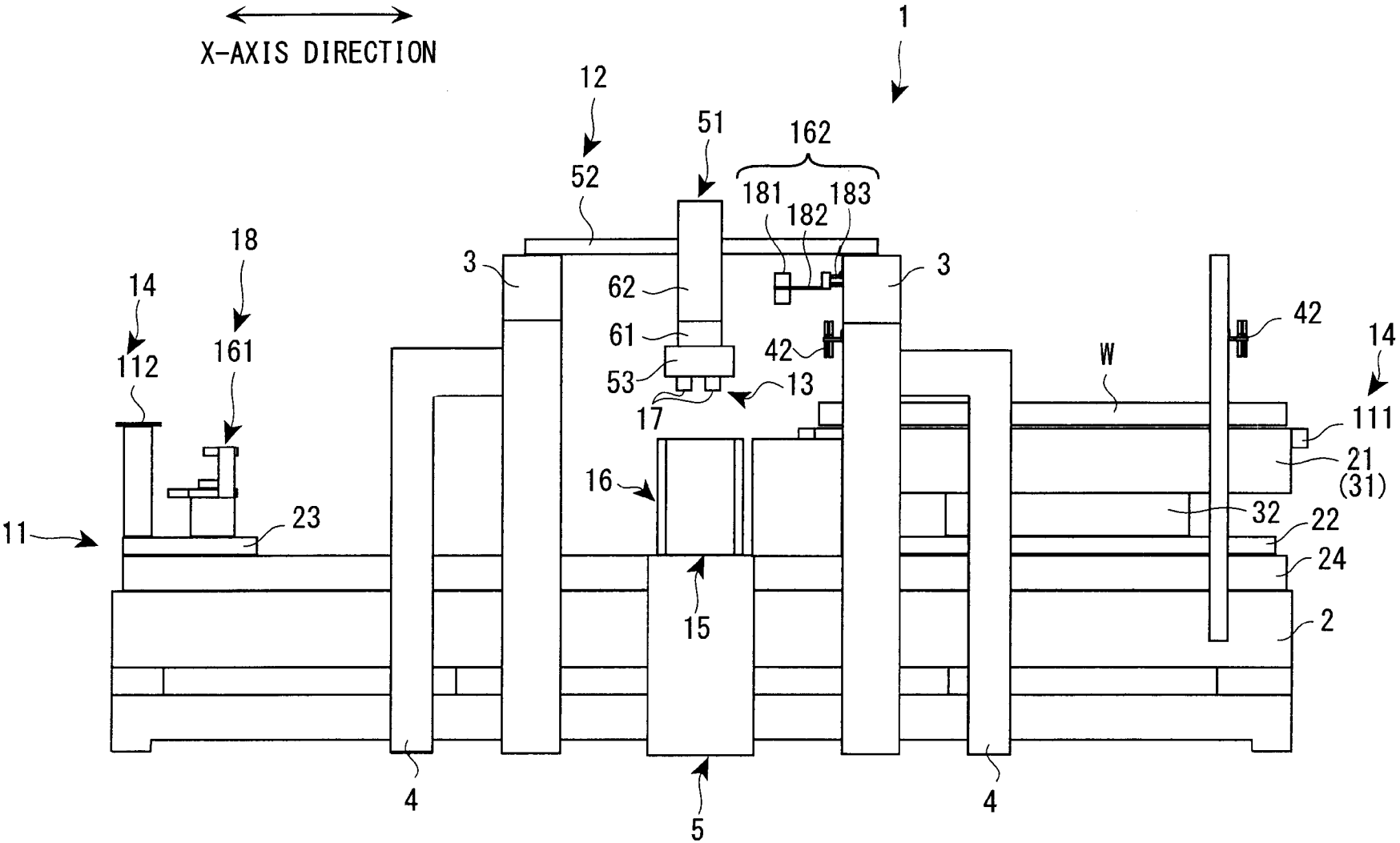
FIG. 2 is a side view of the liquid droplet ejection apparatus.

As shown in FIGS. 1 and 2, a liquid droplet ejection apparatus 1 includes an X-axis table 11, a Y-axis table 12, and ten carriage units 51. The X-axis table 11 is disposed on an X-axis supporting base 2 mounted on a stone surface plate, extends in an X-axis direction which is a main scanning direction, and moves a workpiece W in the X-axis direction (main scanning direction). The Y-axis table 12 is disposed on a pair of (two) Y-axis supporting bases 3 which is arranged so as to stride across the X-axis table 11 with a plurality of poles 4 interposed between the Y-axis supporting bases 3 and the X-axis table 11, and extends in a Y-axis direction which is a sub-scanning direction. Ten carriage units 51 include a plurality of functional liquid droplet ejection heads 17 (not shown) mounted thereon, and are arranged so as to hang from the Y-axis table 12. The functional liquid droplet ejection heads 17 are driven to perform ejection processing in synchronization with driving operations of the X-axis table 11 and the Y-axis table 12 whereby functional liquid droplets of three colors, R, G, and B are ejected and a predetermined plotting pattern is plotted on the workpiece W.

The liquid droplet ejection apparatus 1 further includes a maintenance unit 5 having a flushing unit 14, a suction unit 15, a wiping unit 16, and an ejection function inspection unit 18, which is used for maintenance of the functional liquid droplet ejection heads 17 so that functional maintenance and functional recovery of the functional liquid droplet ejection heads 17 are achieved. Note that, among the units constituting the maintenance unit 5, the flushing unit 14 and the ejection function inspection unit 18 are mounted on the X-axis table 11, the suction unit 15 and the wiping unit 16 are disposed on a mount 6 which is disposed so as to be displaced from the X-axis table 11 and is disposed in a position which does not disturb movement of the carriage units 51 moved using the Y-axis table 12.

The flushing unit 14 includes a pair of pre-plotting flushing units 111, 111 and a periodic flushing unit 112. The flushing unit 14 receives ejected ink to be lapsed from the functional liquid droplet ejection heads 17 (flushing), which is performed just before the ejection from the functional liquid droplet ejection heads 17 and in a plotting process quiescent period at the time of changing workpieces W. The suction unit 15 includes a plurality of divided suction units and forcibly sucks the liquid droplets from ejection nozzles 98 of each of the functional liquid droplet ejection heads 17. The wiping unit 16 has a wiping sheet 151 and wipes off a nozzle surface 97 of the functional liquid droplet ejection head 17 after the suction. The ejection performance inspection unit 18 is used to inspect an ejection performance of the liquid droplet ejection heads 17 (the details will be explained later).

Components of the liquid droplet ejection apparatus 1 will be described hereinafter. As shown in FIGS. 1 and 2, the X-axis table 11 includes a set table 21, an X-axis first slider 22, an X-axis second slider 23, a pair of right and left X-axis linear motors (not shown), and a pair of (two) X-axis common supporting bases 24. The set table 21 is used to set the workpiece W. The X-axis first slider 22 is used to slidably support the set table 21 in the X direction. The X-axis second slider 23 is used to slidably support the flushing unit 14 and the ejection function inspection unit 18 in the X-axis direction. The pair of X-axis linear motors extend in the X-axis direction, are used to move the set table 21 (the workpiece W) in the X-axis direction through the X-axis first slider 22, and are used to move the flushing unit 14 and the ejection function inspection unit 18 in the X-axis direction through the X-axis second slider 23. The pair of X-axis common supporting bases 24 are arranged so as to be parallel to the X-axis linear motors and guide the X-axis first slider 22 and the X-axis second slider 23.

The set table 21 includes a suction table 31 for attracting the workpiece W to be set thereto and a θ table 32 for correcting a position of the workpiece W set on the suction table 31 in a θ-axis direction. Furthermore, a pair of pre-plotting flushing unit 111 are additionally provided on a pair of sides of the set table 21 which is parallel to the Y-axis direction.

Note that a near side of the sheet shown in FIG. 1 serves as an alignment position 41 of the workpiece W. When a workpiece W that has yet to be processed is mounted on the suction table 31 or when a processed workpiece W is dismounted, the suction table 31 moves up to the alignment position 41. Then, a workpiece W is mounted on or dismounted from (replacement) the suction table 31 using a robot arm (not shown). Furthermore, a workpiece alignment camera 42 facing to the mounted workpiece W from above is used to recognize a position of the workpiece W. In accordance with an imaging result of the workpiece alignment camera 42, data in the X-axis direction and data in the Y-axis direction are corrected, and the workpiece W is corrected in the θ direction using the θ table 32.

The Y-axis table 12 includes ten bridge plates 52 on which the ten carriage units 51 are suspended, and ten pairs of Y-axis sliders (not shown) which support the corresponding bridge plates 52 at both sides thereof. In addition, the Y-axis table 12 includes a pair of Y-axis linear motors (not shown) which are disposed on the pair of Y-axis supporting bases 3 and which are used to move the ten bridge plates 52 in the Y-axis direction through the ten pairs of Y-axis sliders. Further, the Y-axis table 12 makes the functional liquid droplet ejection heads 17 face the maintenance unit 5, while sub scanning the functional liquid droplet ejection heads 17 with each of the carriage units 51 when plotting.

When the pair of linear motors are (simultaneously) driven, the Y-axis sliders move in parallel to the Y-axis direction with the pair of Y-axis supporting bases 3 as guides. Therefore, the bridge plates 52 move in the Y-axis direction along with the carriage units 51. In this case, each of the carriage units 51 may independently move by drive-controlling the Y-axis linear motors, or the ten carriage units 51 may integrally move.

Figure 4:
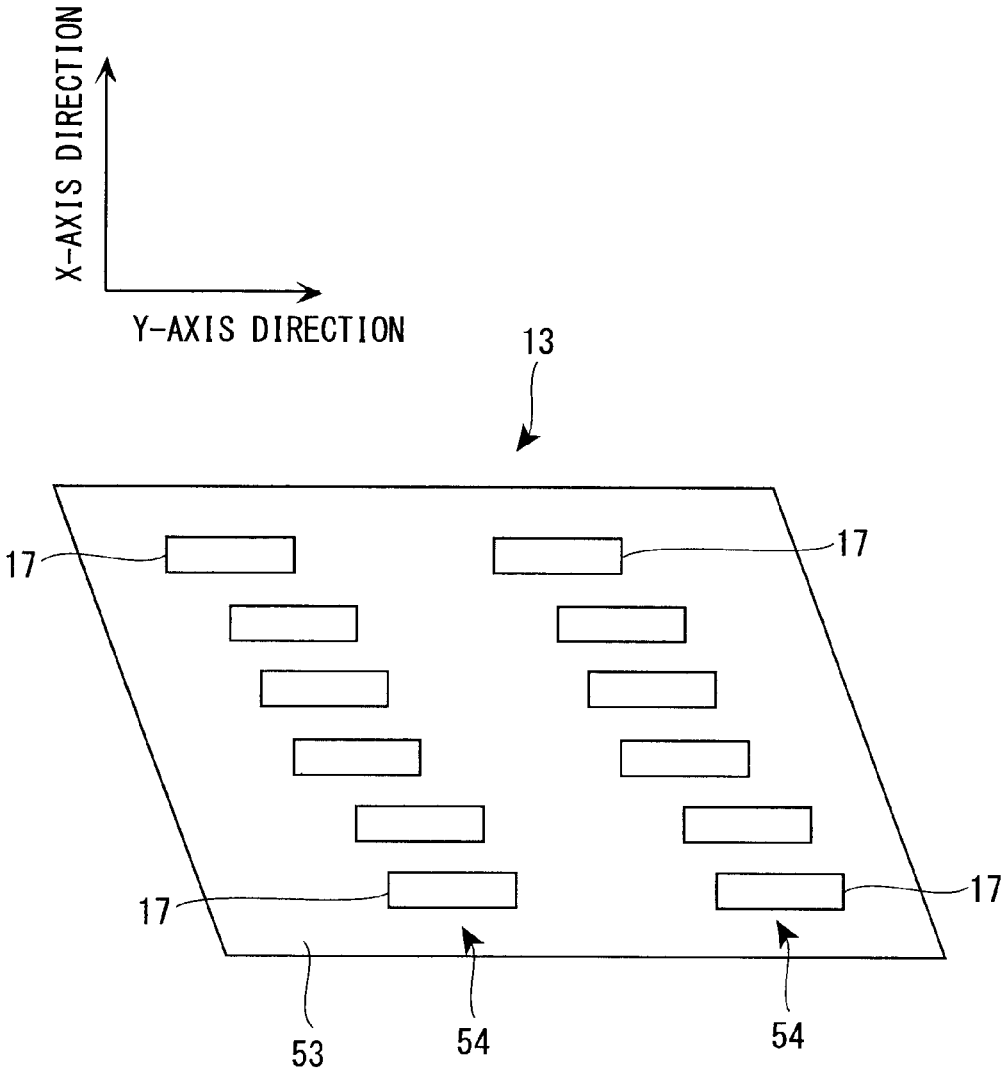
FIG. 4 is a view of the functional liquid droplet ejection head constituting a head group.

Each of the carriage units 51 includes a head unit 13 having 12 functional liquid droplet ejection heads 17 and a carriage plate 53 in which the 12 functional liquid droplet ejection heads 17 are arranged thereon so as to be divided into two groups each of which has six functional liquid droplet ejection heads 17 (refer to FIG. 4). Further, each of the carriage units 51 includes a θ-rotation unit 61 which supports the head unit 13 and which performs a θ correction (θ rotation) on the head unit 13, and a hanging member 62 which supports the head unit 13 through the θ-rotation unit 61 so that the Y-axis table 12 (each of the bridge plates 52) supports the head unit 13.

Figure 3:
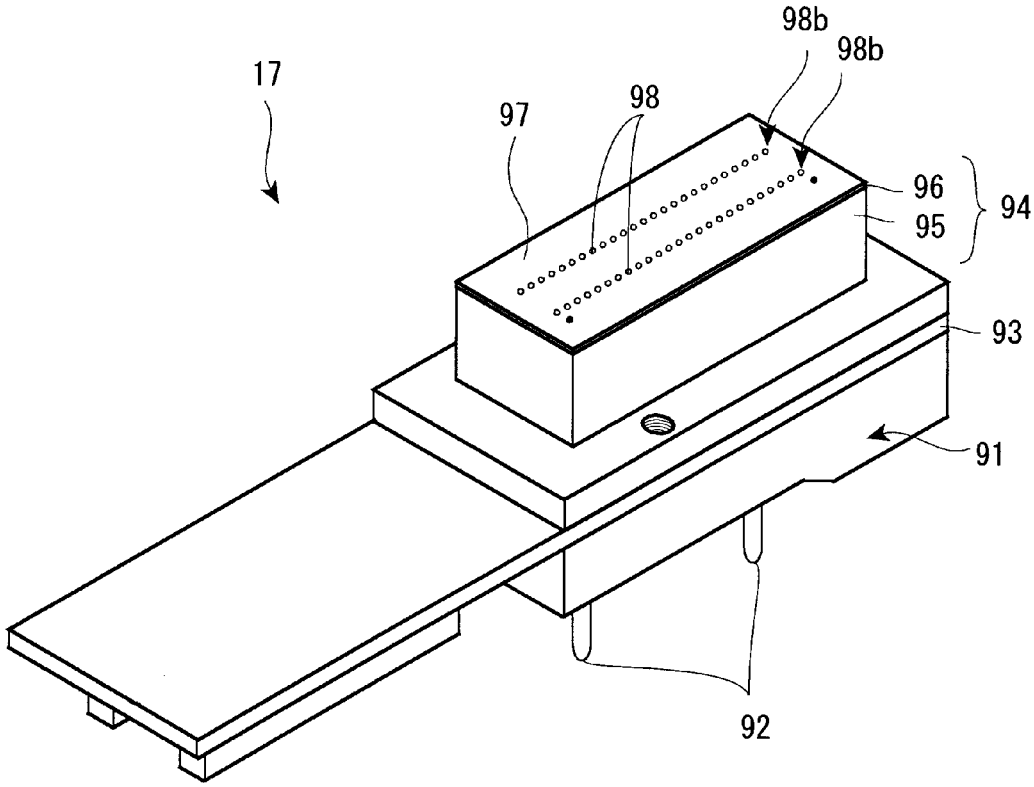
FIG. 3 is a perspective view of a functional liquid droplet ejection head.

As shown in FIG. 3, each of the functional liquid droplet ejection heads 17 is a so-called twin-type head, and includes a functional liquid introduction unit 91 having twin connecting needles 92, twin head boards 93 continuing from the functional liquid introduction unit 91, and a head body 94 continuing downwardly of the functional liquid introduction unit 91 and being formed with an in-head flow path filled with the functional liquid therein. The connecting needle 92 is connected to a functional liquid tank (not shown) and supplies the functional liquid to the functional liquid introduction unit 91. The head body 94 includes a cavity 95 (piezoelectric element), and a nozzle plate 96 having a nozzle surface 97 including a number of ejection nozzles 98 opening therethrough. When the functional liquid droplet ejection heads 17 are driven for ejection, a voltage is applied to the piezoelectric element and the functional liquid droplets are ejected from the ejection nozzles 98 by a pumping action of the cavities 95.

On the nozzle surface 97, two split nozzle rows 98*b* are formed in parallel from each other, which includes a number of ejection nozzles 98. The two split nozzle rows 98*b* are displaced by a half nozzle pitch from each other. Also, the functional liquid droplet ejection heads 17 is constructed to be able to eject the liquid droplet from each of the ejection nozzles 98 freely.

As shown in FIG. 4, the head unit 13 includes the carriage plate 53 which has the plurality of (12) functional liquid droplet ejection heads 17 arranged thereon. The 12 functional liquid droplet ejection heads 17 are divided in the Y-axis direction into two head groups 54 each of which has six functional liquid droplet ejection heads 17 aligned in stepwise manner in the X-axis direction. In this embodiment, three plotting lines of R, G and B continuing in the Y-axis direction are formed respectively by two sub-scannings of all the functional liquid droplet ejection heads 17 (12×10). A length of each of the plotting line corresponds to a width of a workpiece W having a maximum size capable of being mounted on the set table 21.

Figure 5:
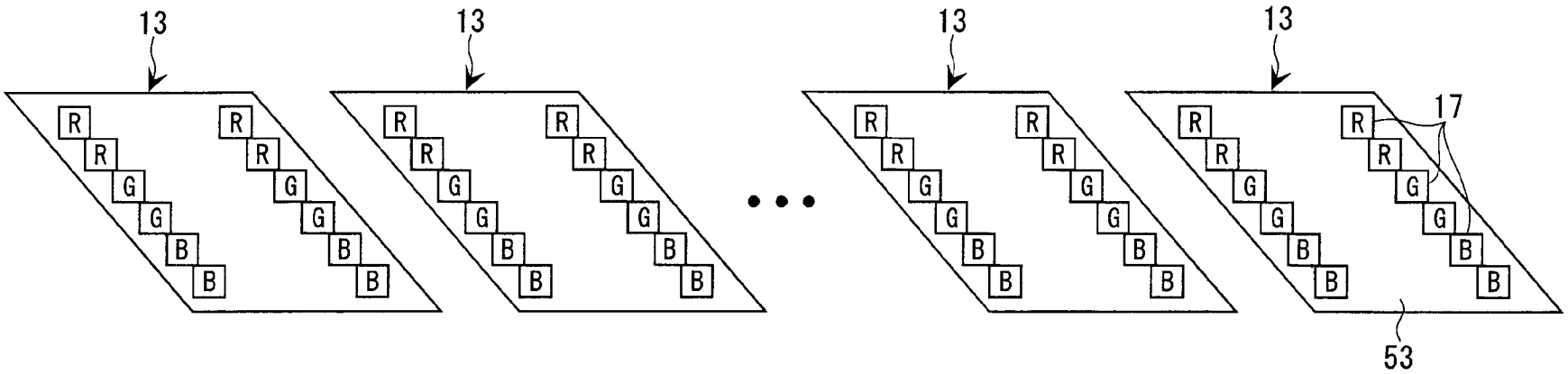
FIG. 5 is an explanatory view for an arrangement pattern of the functional liquid droplet ejection head mounted on a head unit.
Figure 6A:
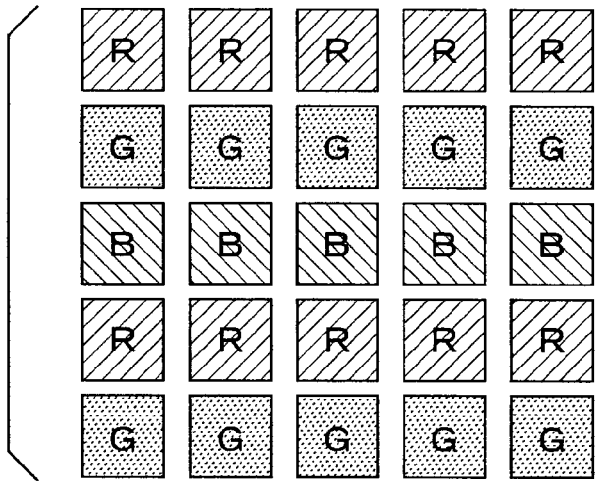
FIGS. 6A to 6C are explanatory views for an arrangement pattern of a color filter, in which a stripe arrangement, a mosaic arrangement, a delta arrangement are shown, respectively.
Figure 6B:
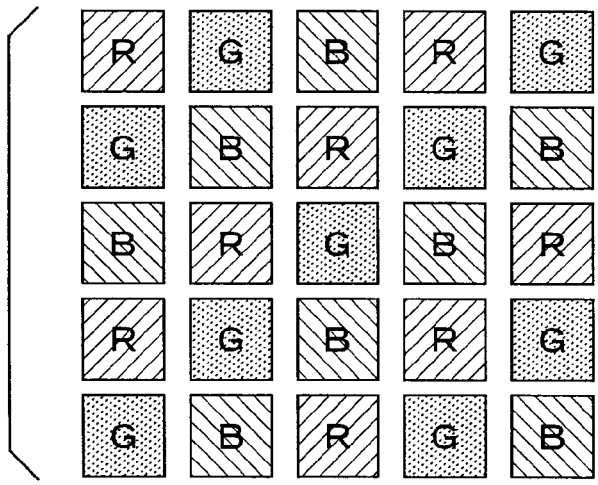
Figure 6C:
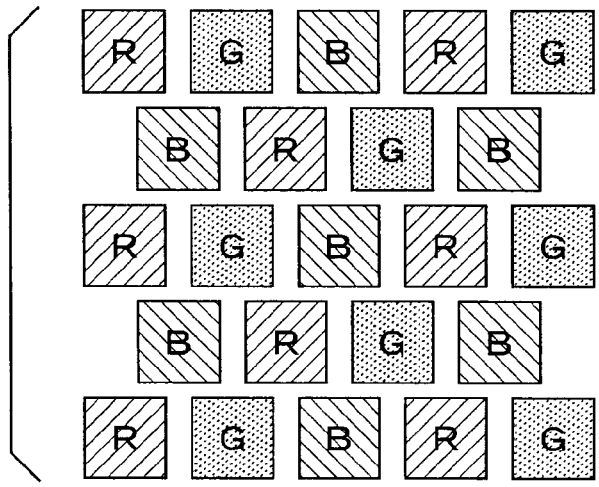

Each of the plurality of (12×10) functional liquid droplet ejection heads 17 included in the head unit 13 corresponds to one of three colors R, G, and B (refer to FIG. 5), and therefore, a plotting pattern formed from the three color functional liquids can be plotted on the workpiece W. There are three plotting patterns as shown in FIGS. 6A to 6C. In this embodiment, the plotting pattern (bit map data) shown in FIG. 6A is used for plotting.

A plotting operation of the liquid droplet ejection apparatus 1 is performed as follows. The first plotting operation (outward movement path) is done by moving the workpiece W in the X-axis direction by the X-axis table (to the upper side in FIG. 1). Then, the second plotting operation (homeward movement path) is done by moving the workpiece W in the X-axis direction (to the lower side in FIG. 1) with a movement (sub scanning) of the head unit 13 in the Y-axis direction by a length of two heads. The third plotting operation (outward movement path) is done by sub scanning the head unit 13 by a length of two heads again, then, by moving the workpiece W in the X-axis direction (to the upper side in FIG. 1) again. Thus, plotting processes of three colors, R, G, and B can be performed effectively by repeating the movements of the workpiece W and the plotting operations three times while changing corresponding functional liquid droplet ejection heads by sub scanning with respect to the position on the workpiece W.

Figure 7:
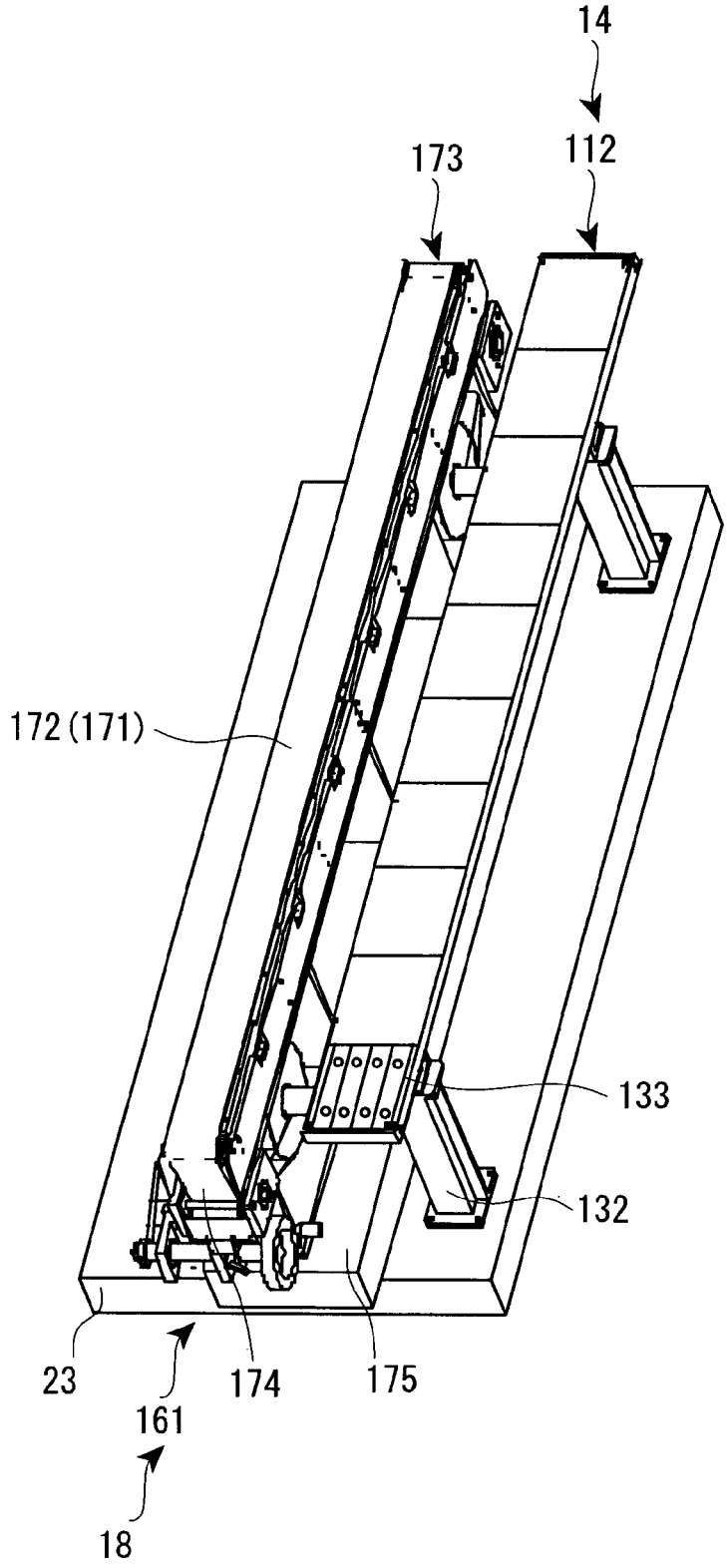
FIG. 7 is a perspective view of a second slider and the vicinity thereof.

As shown in FIGS. 1, 2, and 7, the ejection function inspection unit 18 is used to inspect whether (the ejection nozzles 98 of) all of the functional liquid droplet ejection heads 17 disposed on the head unit 13 properly eject the functional liquid. The ejection function inspection unit 18 includes a plotted unit 161 which receives the functional liquid inspection-ejected based on a predetermined inspection pattern from the ejection nozzles 98 of the functional liquid droplet ejection heads 17, and a landed dot measuring unit (a landed dot measuring device) 162 which measures volume and the position offset amount of a landed dot D (refer to FIG. 10) which is a functional liquid droplet inspection-ejected on the plotted unit 161. Note that the plotted unit 161 is mounted on the X-axis table 11 and the landed dot measuring unit 162 is disposed at an inspection position just below the Y-axis table 12.

The plotted unit 161 includes an inspection sheet 171 in a lengthy form, an inspection stage 172, a sheet feeder 173, a sheet feeder supporting member 174, and a unit base 175. The inspection sheet 171 receives the functional liquid inspection-ejected from the functional liquid droplet ejection heads 17 at the time of the inspection ejection. The inspection sheet 171 is mounted on the inspection stage 172. The sheet feeder 173 is used to feed a portion of the inspection sheet 171 which has been inspected out of the inspection stage 172, and to feed a portion of the inspection sheet 171 which has not yet to be inspected into the inspection stage 172. The sheet feeder 173 is supported by the sheet feeder supporting member 174, and the sheet feeder supporting member 174 is supported by the unit base 175. The plotted unit 161 receives inspection ejection at the non-plotted portion thereof after the inspection pattern has been plotted on the inspection sheet 171, the landed dot measuring unit 162 has activated, the inspected portion has been fed by the sheet feeder 173 and the plotted portion has been replaced with the non-plotted portion.

Figure 9:
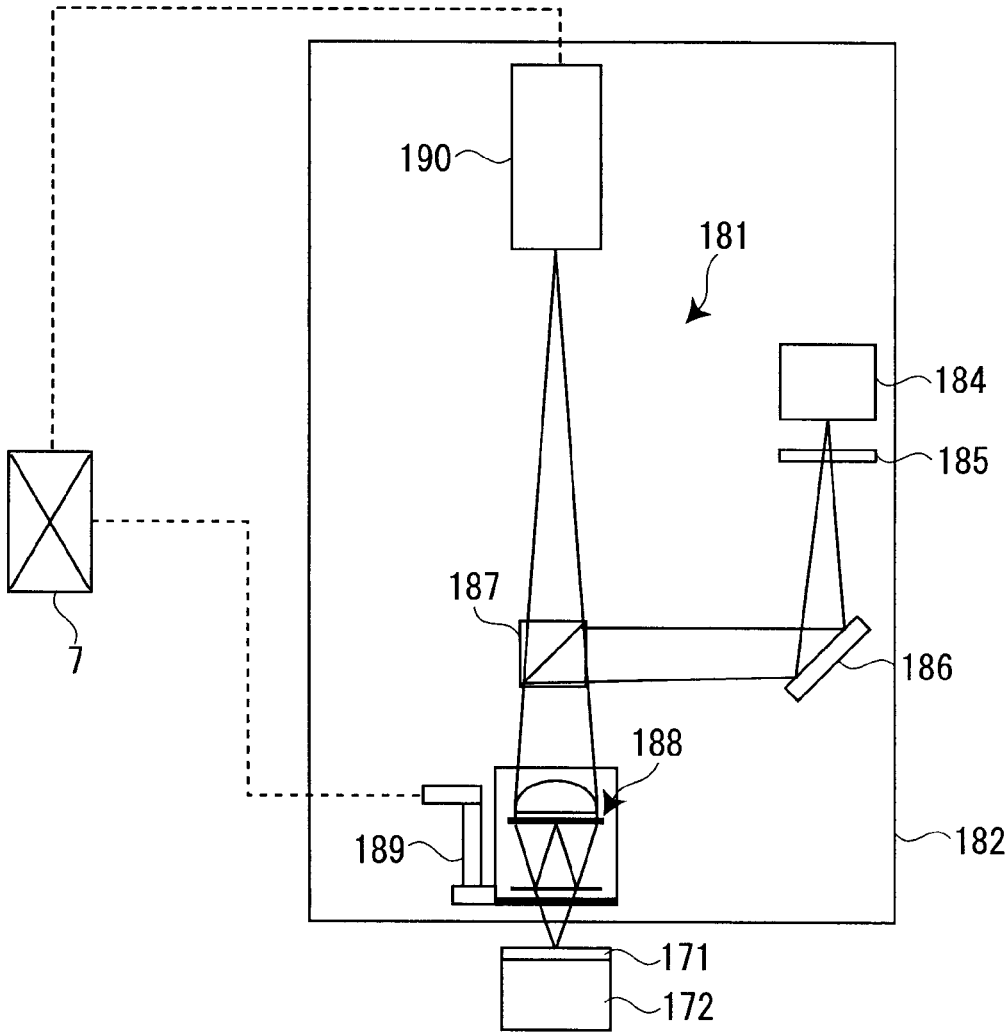
FIG. 9 is a diagram of a vicinity of a white-light interferometer and the vicinity thereof in a landed dot measuring unit.
Figure 10A:
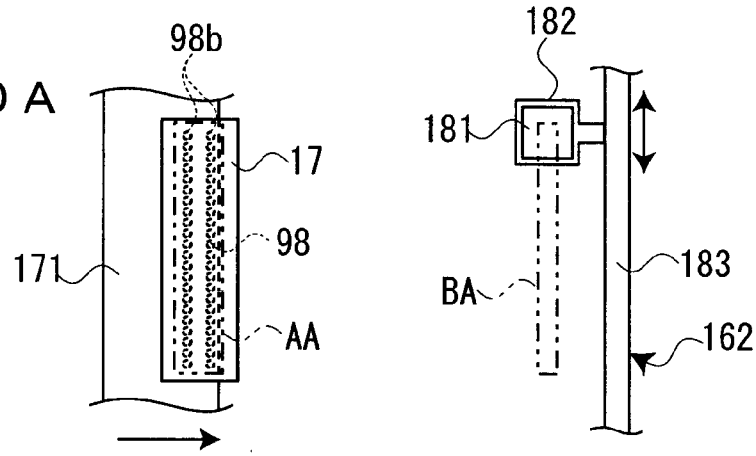
FIGS. 10A to 10D are explanatory views for an ejection performance inspection process.
Figure 10B:
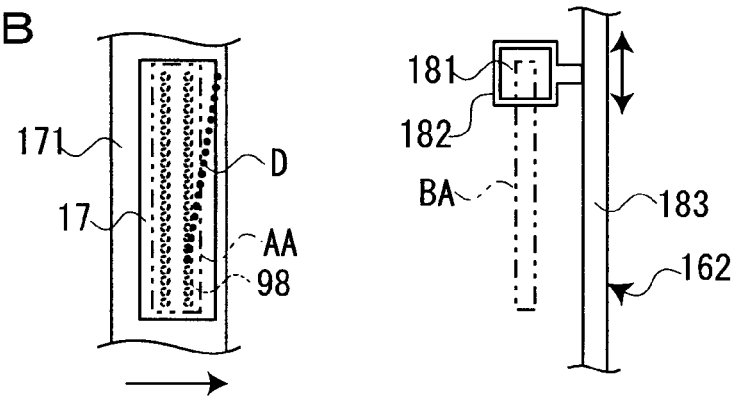
Figure 10C:
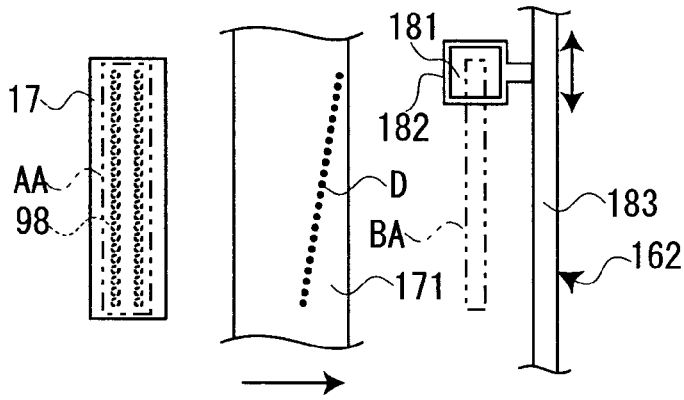
Figure 10D:
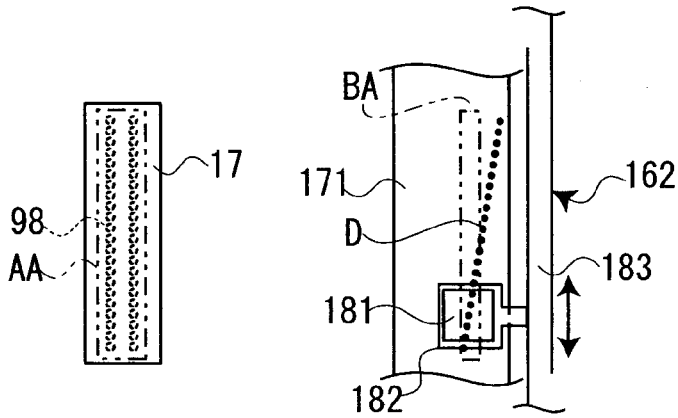

As shown in FIG. 2, 9 and 10, the landed dot measuring unit 162 has a white-light interferometer (a topology measuring device) 181, a device holder 182, device moving mechanism 183, and a device moving motor (not shown). The white-light interferometer 181 is supported on the above mentioned Y-axis support base 3 so as to face to the X table 11 from the above and measures surface topology of each of the landed dots which landed on the inspection sheet 171. The device holder 182 holds the white-light interferometer 181. The device moving mechanism 183 slidably supports the white-light interferometer 181 in the Y-axis direction with the device holder 182. The device moving motor moves the white-light interferometer 181 in the Y-axis direction by the device moving mechanism 183.

As shown in FIG. 9, the white-light interferometer 181 includes a white-color LED 184, an interference filter 185 (a band pass filter), a reflector 186, a beam splitter 187, an interference type objective lens 188, a piezo-Z-axis table 189, and an imaging camera (a CCD camera) 190. The white-color LED 184 is a light source emitting white light. The interference filter 185 is provided at a downstream side in a radiated direction of the white-color LED 184 and filters white light. The reflector 186 is provided at a downstream side of the interference filter 185 and reflects the white light orthogonally. The beam splitter 187 is provided at a downstream side of the reflector 186 and reflects the white light orthogonally towards an interference type objective lens 188, while transmitting a reflected light reflected from the landed dot D. The interference type objective lens 188 is provided at a downstream side of the beam splitter 187. The piezo-Z-axis table 189 makes the interference type objective lens 188 vibrate minutely in a Z-axis direction. The imaging camera 190 takes reflected light reflected from the workpiece W via the interference type objective lens 188 and the beam splitter 187. The white-light interferometer 181 obtains the surface topology of the object as interference stripes in an image form. A topology measuring result by the white-light interferometer 181 (an image taking result by the imaging camera 190) is sent to the control device 7 for image recognition. A characteristics (existence and non-existence of the landed dot, the volume of the landed dot D, the position offset of the landed dot D, and a flight deflection) of each of the ejection nozzles 98 of each of the functional liquid droplet ejection heads 17 based on the image recognition. That is, the ejection inspection device has the landed dot measuring unit 162 and the control device 7.

The volume of the landed dot D is measured by analyzing the surface topology of the landed dot D measured (image taken) by the white-light interferometer 181. First of all, the volume of the landed dot D is calculated based on the measured (image taken) surface topology and a position (a height level of the surface) of the inspection sheet, and it is determined if the volume is within a reference range. In a case that a measured value is out of the reference range, it is determined that an ejection amount from the ejection nozzle 98 is not normal. Concurrently, it is determined if the position of the landed dot D (strictly, the center position of the landed dot D) is off the pre-appointed landing position. The position offset amount between the landed position of the landed dot D and the pre-appointed landing position is detected and it is determined if the detected result is beyond the reference value. When the detected result is beyond the reference value, it is determined that the ejection nozzle 98 is not normal. Similarly, the flight deflection is detected and a dot drop out is also detected based on the existence and the non-existence of the landed dot D.

Figure 8:
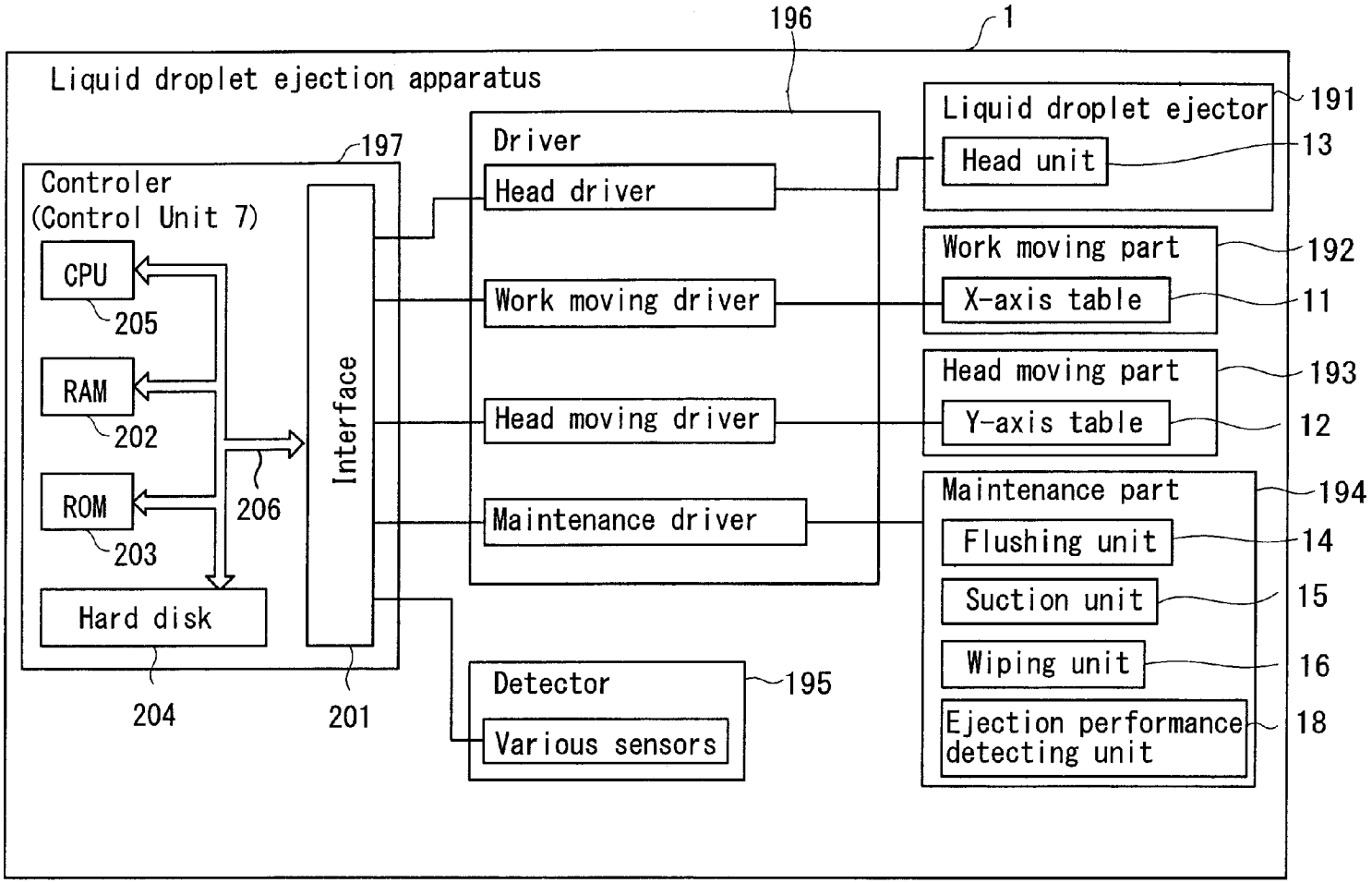
FIG. 8 is a block diagram showing a main control system of a plotting apparatus.

Referring to FIG. 8, a main control system of the liquid droplet ejection apparatus 1 will be described. As shown in FIG. 8, the liquid droplet ejection apparatus 1 includes a liquid droplet ejection section 191, a workpiece moving section 192, a head moving section 193, a maintenance section 194, a detector 195, a driving section 196, and a controller 197 (the control unit 7). The liquid droplet ejection section 191 includes the head unit 13 (the functional liquid droplet ejection heads 17). The workpiece moving section 192 includes the X-axis table 11 and is used to move the workpiece W in the X-axis direction. The head moving section 193 includes the Y-axis table 12 and is used to move the head unit 13 in the Y-axis direction. The maintenance section 194 includes units used for maintenance. The detector 195 includes various sensors used for various detection operations. The driving unit 196 includes various drivers which control and drive these individual sections. The controller 197 is connected to the individual sections and entirely controls the liquid droplet ejection apparatus 1.

The controller 197 includes various components such as an interface 201, a RAM 202, a ROM 203, a hard disk 204, a CPU 205, and a bus 206. The interface 201 is used to connect the various units to each other. The RAM 202 has a storage area capable of storing data temporarily and is used as a workspace for control processing. The ROM 203 has various storage areas and is used to store control programs and control data. The hard disk 204 stores plotting data used when a predetermined plotting pattern is plotted onto the workpiece W and various data, etc., transmitted from the various units, and further stores programs, etc, used for processing the various data. The CPU 205 performs calculation processing for the various data in accordance with the programs, etc., stored in the ROM 203 and the hard disk 204. The bus 206 is used to connect the components to each other.

The controller 197 is used to input the various data transmitted from the various units through the interface 201 and allows the CPU 205 to perform the calculation processing in accordance with the programs stored in the hard disk 204 (or in accordance with the programs read sequentially using a CD-ROM drive, for example). A result of the calculation processing is output to the units through the driving section 196 (the various drivers). Thus, the liquid droplet ejection apparatus 1 is entirely controlled and various operations of the liquid droplet ejection apparatus 1 are performed Next, referring to FIG. 10, operating procedures for the ejection characteristics inspection of the functional liquid droplet ejection head 17 will be explained. First of all, the plotted unit 161 on the X-axis second slider 23 is moved to face to the functional liquid droplet ejection head 17 by the controller 197. Strictly speaking, the plotted unit 161 is moved such that the edge portion thereof in the X-axis direction is located to face to the nozzle rows 98*b* of the functional liquid droplet ejection head 17 (refer to FIG. 10A). Then, the plotted unit 161 is moved at a same speed by the X-axis second slider 23 on an ejection area AA of the functional liquid droplet ejection head 17, between the ejection area AA and a measuring area BA of the landed dot measuring unit 162, and on the measuring area BA, thereby various operations being performed.

When the plotted unit 161 is moving on the ejection area AA (refer to FIG. 10B), the functional liquid droplet ejection head 17 is driven and the inspection ejection of each of the ejection nozzles is performed. The inspection ejection is performed such that each of the ejection nozzles 98 ejects for inspection one by one from the end thereof sequentially at a time interval. To this end, each of the landed dots D ejected from each of the ejection nozzles 98 is inspection-ejected obliquely straight manner (an inspection pattern) on the inspection sheet 171 (refer to FIG. 10C).

When the plotted unit 161 is moved onto the measuring area BA (refer to FIG. 10D), the landed dot measuring unit 162 is driven to measure each of the landed dots D. In terms of measuring the landed dot D, the landed dot D which arrived on the measuring area BA of the landed dot measuring unit 162 is measured with moving the white-light interferometer 181 in the Y-axis direction by the device moving mechanism 183. As each of the ejection nozzles 98 of the functional liquid droplet head 17 ejects one by one at an equal space, landed dots D arrive on the measuring area BA in the order of the ejection. Thus, during the inspection ejection and the measurement for the landed dots D, as the plotted unit 161 moves at a same speed and the landed dots D are measured in the order of the ejection, time periods from the ejection to the measurement of the landed dots D from the respective ejection nozzles 98 become even. Note that the above measurement is done by repeating the same operations described above per nozzle row 98*b*.

With such a construction, it is possible to make the time period from the ejection through each of the ejection nozzles 98 to the measurement even, and it is possible to make the time period from the landing to the measurement of each of the landed dots D even. Therefore, as differences among landed dots D by influences of evaporation, etc., do not occur, it is possible to measure the landed dots D through each of the ejection nozzles 98 relatively, leading to an accurate measurement. A plurality of ejection nozzles 98 is inspection-ejected one by one at a time interval while moving the functional liquid droplet ejection head 17, and the measurement is done while moving the plotted unit 161 at a same speed as the functional liquid droplet ejection head 17. In other words, it is possible to measure the landing of each of the landed dots D in a short time and effectively by measuring while the white-light interferometer 181 is caused to follow the functional liquid droplet ejection head 17 at a same speed as the functional liquid droplet ejection head 17.

Above operations are performed for each of the functional liquid droplet ejection heads 17. In a case that the operations are performed for all of the functional liquid droplet ejection heads, the above operations are repeated by multiple times. Also, in the embodiment, each of the functional liquid droplet ejection heads 17 ejects one by one and the landed dots D are measured one by one. If the white-light interferometer 181 can measure a plurality of landed dots D at one measurement, it is possible to cause a plurality of the ejection nozzles 98 of the functional liquid droplet ejection head 17 to eject and to measure a plurality of landed dots D. Also, it is possible to form each of the landed dots D with a plurality of shots of the functional liquid droplet.

With the construction above, it is possible to make the time period from the ejection through each of the ejection nozzles 98 to the measurement even, and it is possible to make the time period from the landing to the measurement of each of the landed dots D even. Therefore, as differences among landed dots D by influences of evaporation, etc., do not occur, it is possible to measure the landed dots D through each of the ejection nozzles 98 relatively, leading to an accurate measurement. It is possible to measure the landing of each of the landed dots D in a short time and effectively by moving the functional liquid droplet ejection head 17, inspection-ejecting one by one at a time interval though a plurality of ejection nozzles 98, and measuring while causing the white-light interferometer 181 to follow the functional liquid droplet ejection head 17 at a same speed as the functional liquid droplet ejection head 17. Further, based on the result of the volume measurement for each of the landed dots D, the functional liquid droplet ejection head 17 having the ejection nozzle 98 of which volume is beyond an acceptable amount is used in which an ejecting amount thereof is adjusted by alternating a driving voltage therefor, or the functional liquid droplet ejection head 17 is changed. The functional liquid droplet ejection heads 17 adjusted the liquid droplet ejection amount thereof are used for the plotting, thereby avoiding line unevenness and color mixtures in the main scanning direction.

In this embodiment, the inspection sheet 171 (the plotted unit 161) is moved with respect to the functional liquid droplet ejection heads 17 and the white-light interferometer 181. It is possible to fix the inspection sheet 171 (the plotted unit 161) and to cause the functional liquid droplet ejection heads 17 and the white-light interferometer 181 to move.

Further, in this embodiment, the volume and the positional offset amount are measured by the white-light interferometer 181, only the volume can be measured. Also, the topology measurement for the landed dots D is performed by the white-light interferometer 181, but any device can be used such as a laser interferometer, etc., as long as the device is an interferometer. More broadly, any device having an imaging camera which takes an image of the landed dot D from the side or the above or a laser-type distance measuring device can be used if it can measure the topology, and if various pieces of information of the landed dot D can be measured based on data therefrom. In this embodiment, an accurate measurement can be made by using the white-light interferometer 181.

Taking electro-optical apparatuses (flat panel display apparatuses) manufactured using the liquid droplet ejection apparatus 1 and active matrix substrates formed on the electro-optical apparatuses as display apparatuses as examples, configurations and manufacturing methods thereof will now be described. Examples of the electro-optical apparatuses include a color filter, a liquid crystal display apparatus, an organic EL apparatus, a plasma display apparatus (PDP (plasma display panel) apparatus), and an electron emission apparatus (FED (field emission display) apparatus and SED (surface-conduction electron emitter display) apparatus). Note that the active matrix substrate includes thin-film transistors, source lines and data lines which are electrically connected to the thin-film transistors.

Figure 11:
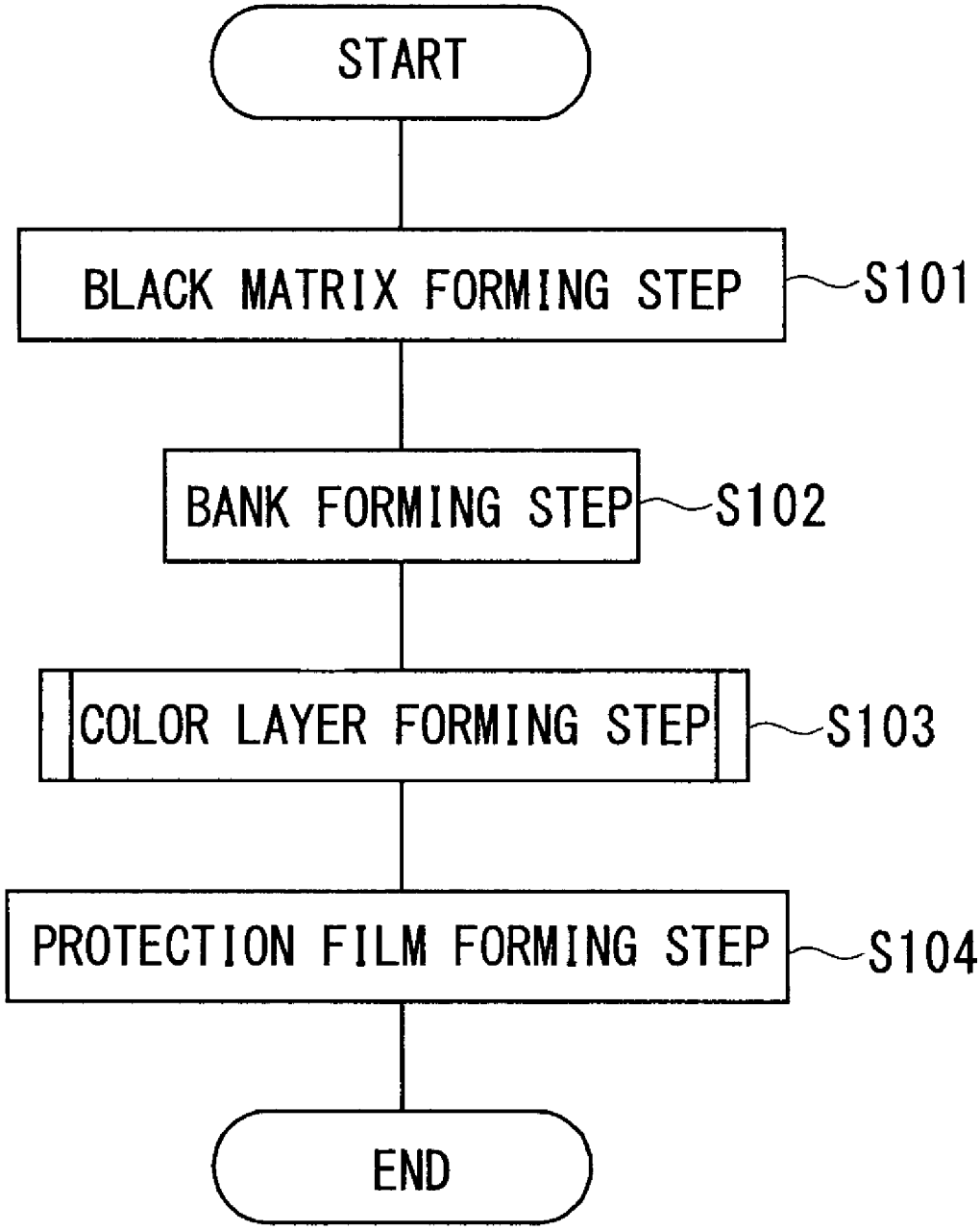
FIG. 11 is a flowchart explaining a color filter manufacturing process.

First, a manufacturing method of a color filter incorporated in a liquid crystal display apparatus or an organic EL apparatus will be described. FIG. 11 shows a flowchart illustrating manufacturing steps of a color filter. FIGS. 12A to 12E are sectional views of the color filter 500 (a filter substrate 500A) of this embodiment shown in an order of the manufacturing steps.

Figure 12A:
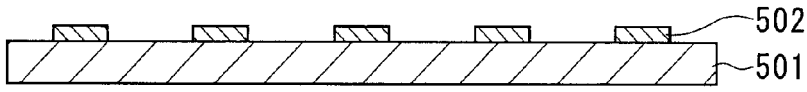
FIGS. 12A to 12E are cross sectional views of a color filter in an order of manufacturing processes.

In a black matrix forming step (step S101), as shown in FIG. 12A, a black matrix 502 is formed on the substrate (W) 501. The black matrix 502 is formed of a chromium metal, a laminated body of a chromium metal and a chromium oxide, or a resin black, for example. The black matrix 502 may be formed of a thin metal film by a sputtering method or a vapor deposition method. Alternatively, the black matrix 502 may be formed of a thin resin film by a gravure printing method, a photoresist method, or a thermal transfer method.

Figure 12B:
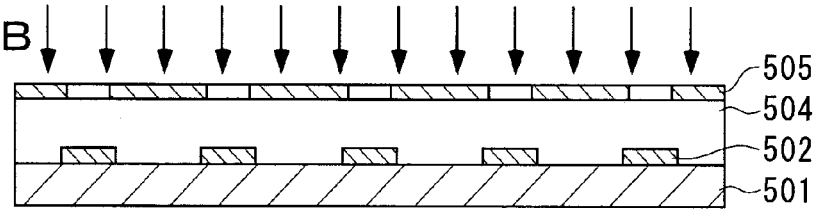

In a bank forming step (step S102), the bank 503 is formed so as to be superposed on the black matrix 502. Specifically, as shown in FIG. 12B, a resist layer 504 which is formed of a transparent negative photosensitive resin is formed so as to cover the substrate 501 and the black matrix 502. An upper surface of the resist layer 504 is covered with a mask film 505 formed in a matrix pattern. In this state, exposure processing is performed.

Figure 12C:
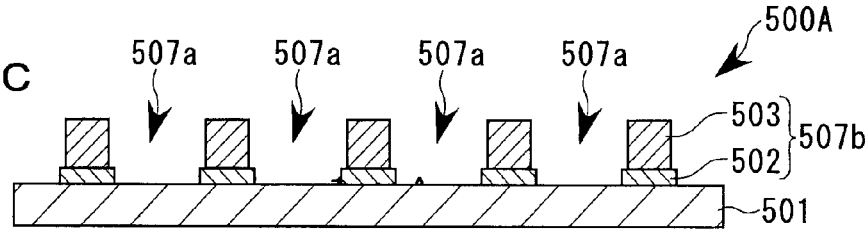

Furthermore, as shown in FIG. 12C, the resist layer 504 is patterned by performing etching processing on portions of the resist layer 504 which are not exposed, and the bank 503 is thus formed. Note that when the black matrix 502 is formed of a resin black, the black matrix 502 also serves as a bank.

The bank 503 and the black matrix 502 disposed beneath the bank 503 serve as a partition wall 507*b* for partitioning the pixel areas 507*a*. The partition wall 507*b* defines receiving areas for receiving the functional liquid ejected when the functional liquid droplet ejection heads 17 form coloring layers (film portions) 508R, 508G, and 508B in a subsequent coloring layer forming step.

The filter substrate 500A is obtained through the black matrix forming step and the bank forming step.

Note that, in this embodiment, a resin material having a lyophobic (hydrophobic) film surface is used as a material of the bank 503. Since a surface of the substrate (glass substrate) 501 is lyophilic (hydrophilic), variation of positions to which the liquid droplet is ejected in the each of the pixel areas 507*a* surrounded by the bank 503 (partition wall 507*b*) can be automatically corrected in the subsequent coloring layer forming step.

Figure 12D:
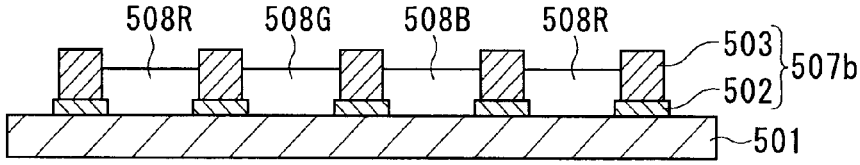

In the coloring layer forming step (S103), as shown in FIG. 12D, the functional liquid droplet ejection heads 17 eject the functional liquid within the pixel areas 507*a* each of which are surrounded by the partition wall 507*b*. In this case, the functional liquid droplet ejection heads 17 eject functional liquid droplets using functional liquids (filter materials) of colors R, G, and B. A color scheme pattern of the three colors R, G, and B may be the stripe arrangement, the mosaic arrangement, or the delta arrangement.

Figure 12E:
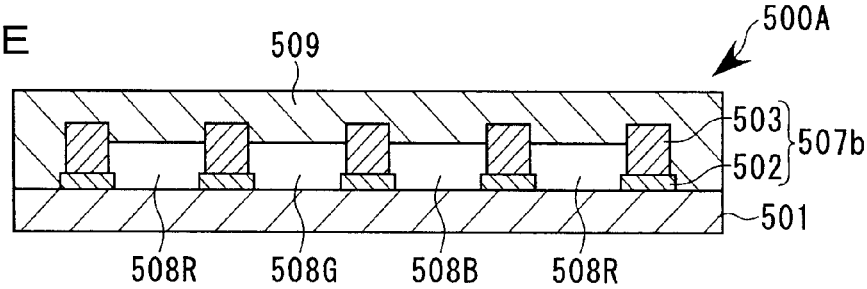

Then drying processing (such as heat treatment) is performed so that the three color functional liquids are fixed, and thus three coloring layers 508R, 508G, and 508B are formed. Thereafter, a protective film forming step is performed (step S104). As shown in FIG. 12E, a protective film 509 is formed so as to cover surfaces of the substrate 501, the partition wall 507*b*, and the three coloring layers 508R, 508G, and 508B.

That is, after liquid used for the protective film is ejected onto the entire surface of the substrate 501 on which the coloring layers 508R, 508G, and 508B are formed and the drying process is performed, the protective film 509 is formed.

In the manufacturing method of the color filter 500, after the protective film 509 is formed, a coating step is performed in which ITO (Indium Tin Oxide) serving as a transparent electrode in the subsequent step is coated.

Figure 13:
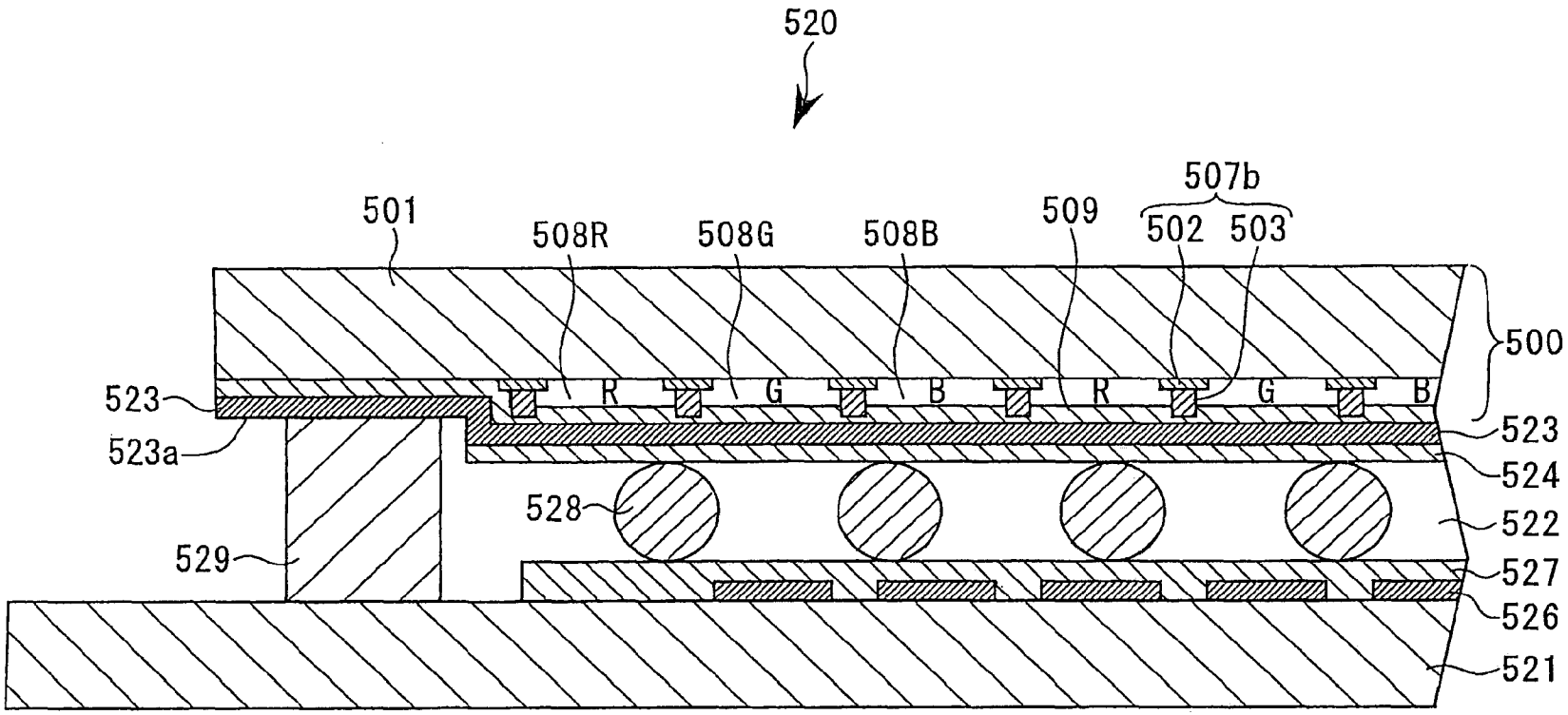
FIG. 13 is a sectional view schematically illustrating an essential part of the first liquid crystal display apparatus employing the color filter according to the embodiment of the invention.

FIG. 13 is a sectional view of an essential part of a passive matrix liquid crystal display apparatus (liquid crystal display apparatus 520) and schematically illustrates a configuration thereof as an example of a liquid crystal display apparatus employing the color filter 500. A transmissive liquid crystal display apparatus as a final product can be obtained by disposing a liquid crystal driving IC (integrated circuit), a backlight, and additional components such as supporting members on the display apparatus 520. Note that the color filter 500 is the same as that shown in FIG. 12, and therefore, reference numerals the same as those used in FIG. 12 are used in FIG. 13 to denote the same components, and descriptions thereof are omitted.

The display apparatus 520 includes the color filter 500, a counter substrate 521 such as a glass substrate, and a liquid crystal layer 522 formed of STN (super twisted nematic) liquid crystal compositions sandwiched therebetween. The color filter 500 is disposed on the upper side of FIG. 13 (on an observer side).

Although not shown, polarizing plates are disposed so as to face an outer surface of the counter substrate 521 and an outer surface of the color filter 500 (surfaces which are remote from the liquid crystal layer 522). A backlight is disposed so as to face an outer surface of the polarizing plate disposed near the counter substrate 521.

A plurality of rectangular first electrodes 523 extending in a horizontal direction in FIG. 13 are formed with predetermined intervals therebetween on a surface of the protective film 509 (near the liquid crystal layer 522) of the color filter 500. A first alignment layer 524 is arranged so as to cover surfaces of the first electrodes 523 which are surfaces remote from the color filter 500.

On the other hand, a plurality of rectangular second electrodes 526 extending in a direction perpendicular to the first electrodes 523 disposed on the color filter 500 are formed with predetermined intervals therebetween on a surface of the counter substrate 521 which faces the color filter 500. A second alignment layer 527 is arranged so as to cover surfaces of the second electrodes 526 near the liquid crystal layer 522. The first electrodes 523 and the second electrodes 526 are formed of a transparent conductive material such as an ITO.

A plurality of spacers 528 disposed in the liquid crystal layer 522 are used to maintain the thickness (cell gap) of the liquid crystal layer 522 constant. A seal member 529 is used to prevent the liquid crystal compositions in the liquid crystal layer 522 from leaking to the outside. Note that an end of each of the first electrodes 523 extends beyond the seal member 529 and serves as wiring 523*a*.

Pixels are arranged at intersections of the first electrodes 523 and the second electrodes 526. The coloring layers 508R, 508G, and 508B are arranged on the color filter 500 so as to correspond to the pixels.

In normal manufacturing processing, the first electrodes 523 are patterned and the first alignment layer 524 is applied on the color filter 500 whereby a first half portion of the display apparatus 520 on the color filter 500 side is manufactured. Similarly, the second electrodes 526 are patterned and the second alignment layer 527 is applied on the counter substrate 521 whereby a second half portion of the display apparatus 520 on the counter substrate 521 side is manufactured. Thereafter, the spacers 528 and the seal member 529 are formed on the second half portion, and the first half portion is attached to the second half portion. Then, liquid crystal to be included in the liquid crystal layer 522 is injected from an inlet of the seal member 529, and the inlet is sealed. Finally, the polarizing plates and the backlight are disposed.

The liquid droplet ejection apparatus 1 of this embodiment may apply a spacer material (functional liquid) constituting the cell gap, for example, and uniformly apply liquid crystal (functional liquid) to an area sealed by the seal member 529 before the first half portion is attached to the second half portion. Furthermore, the seal member 529 may be printed using the functional liquid droplet ejection heads 17. Moreover, the first alignment layer 524 and the second alignment layer 527 may be applied using the functional liquid droplet ejection heads 17.

Figure 14:
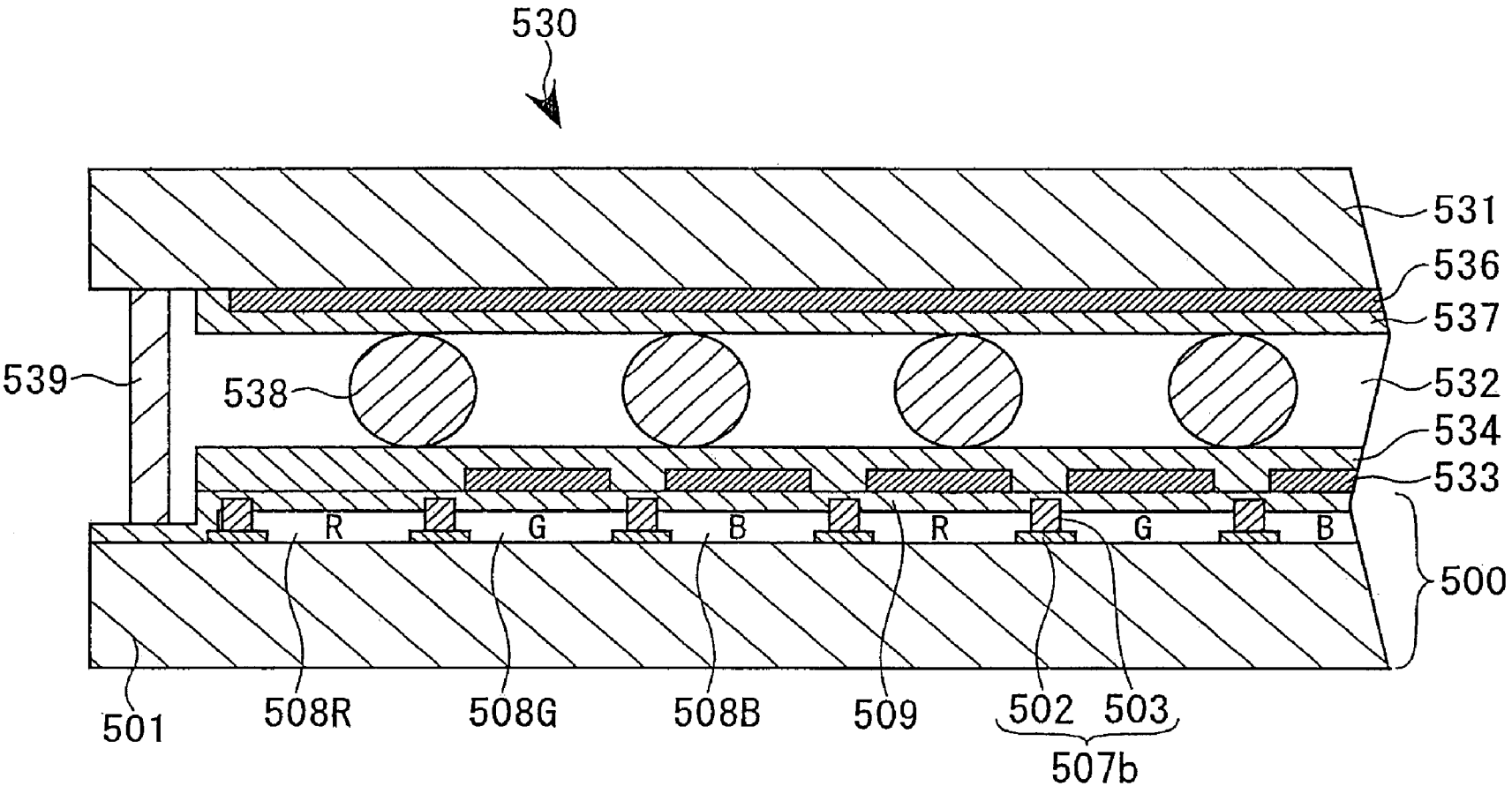
FIG. 14 is a sectional view schematically illustrating an essential part of a liquid crystal display apparatus employing the color filter according to the second embodiment of the invention.

FIG. 14 is a sectional view of an essential part of a display apparatus 530 and schematically illustrates a configuration thereof as a second example of a liquid crystal display apparatus employing the color filter 500 which is manufactured in this embodiment.

The display apparatus 530 is considerably different from the display apparatus 520 in that the color filter 500 is disposed on a lower side in FIG. 14 (remote from the observer).

The display apparatus 530 is substantially configured such that a liquid crystal layer 532 constituted by STN liquid crystal is arranged between the color filter 500 and a counter substrate 531 such as a glass substrate. Although not shown, polarizing plates are disposed so as to face an outer surface of the counter substrate 531 and an outer surface of the color filter 500.

A plurality of rectangular first electrodes 533 extending in a depth direction of FIG. 14 are formed with predetermined intervals therebetween on a surface of the protective film 509 (near the liquid crystal layer 532) of the color filter 500. A first alignment layer 534 is arranged so as to cover surfaces of the first electrodes 533 which are surfaces near the liquid crystal layer 532

On the other hand, a plurality of rectangular second electrodes 536 extending in a direction perpendicular to the first electrodes 533 disposed on the color filter 500 are formed with predetermined intervals therebetween on a surface of the counter substrate 531 which faces the color filter 500. A second alignment layer 537 is arranged so as to cover surfaces of the second electrodes 536 near the liquid crystal layer 532.

A plurality of spacers 538 disposed in the liquid crystal layer 532 are used to maintain the thickness (cell gap) of the liquid crystal layer 532 constant. A seal member 539 is used to prevent the liquid crystal compositions in the liquid crystal layer 532 from leaking to the outside.

As with the display apparatus 520, pixels are arranged at intersections of the first electrodes 533 and the second electrodes 536. The coloring layers 508R, 508G, and 508B are arranged on the color filter 500 so as to correspond to the pixels.

Figure 15:
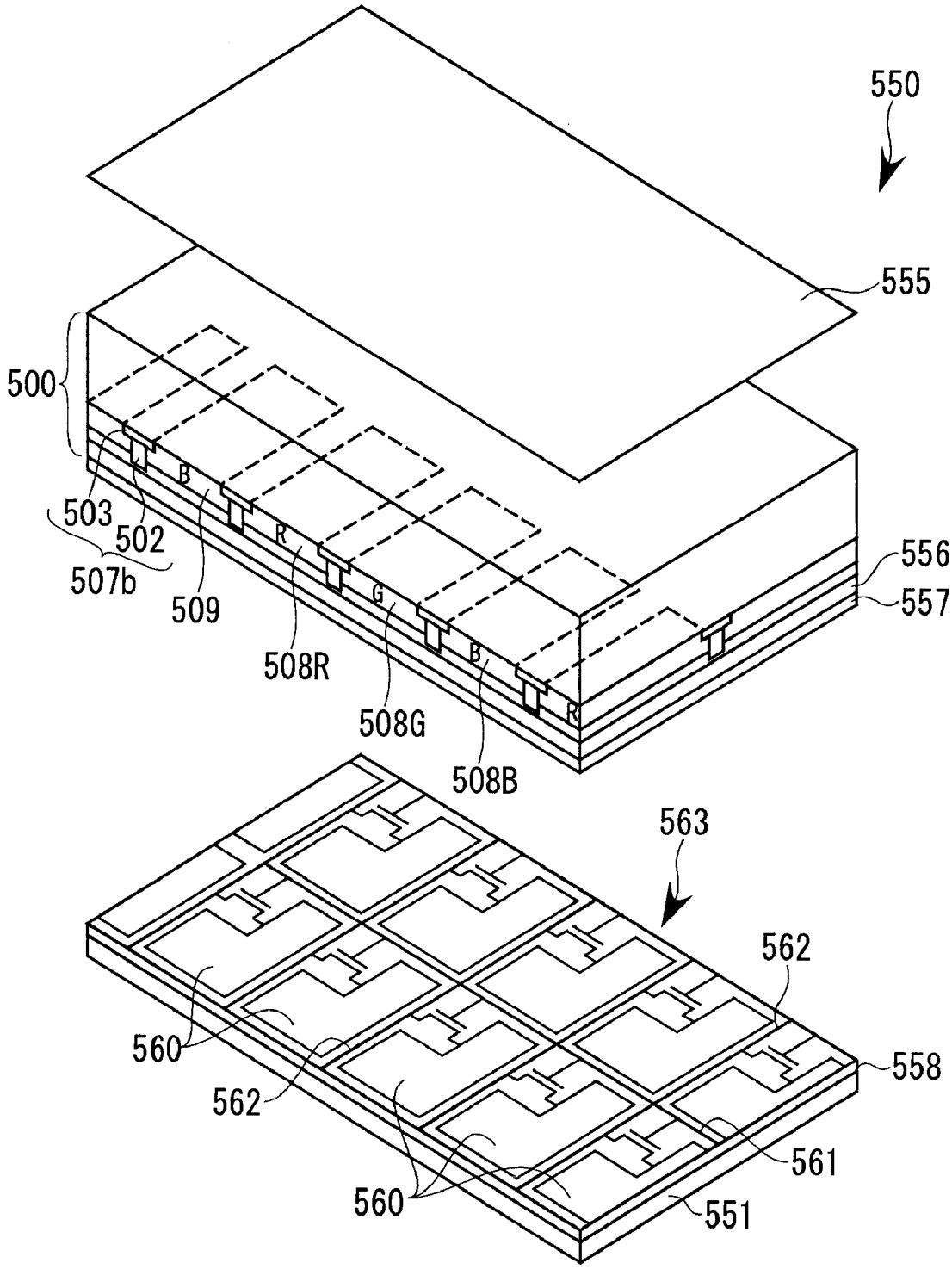
FIG. 15 is a sectional view schematically illustrating an essential part of a liquid crystal display apparatus employing the color filter according to the third embodiment of the invention.

FIG. 15 is an exploded perspective view of a transmissive TFT (thin-film transistor) liquid crystal display device and schematically illustrates a configuration thereof as a third example of a liquid crystal display apparatus employing the color filter 500 to which the present invention is applied.

A liquid crystal display apparatus 550 has the color filter 500 disposed on the upper side of FIG. 15 (on the observer side).

The liquid crystal display apparatus 550 includes the color filter 500, a counter substrate 551 disposed so as to face the color filter 500, a liquid crystal layer (not shown) interposed therebetween, a polarizing plate 555 disposed so as to face an upper surface of the color filter 500 (on the observer side), and a polarizing plate (not shown) disposed so as to face a lower surface of the counter substrate 551.

An electrode 556 used for driving the liquid crystal is formed on a surface of the protective film 509 (a surface near the counter substrate 551) of the color filter 500. The electrode 556 is formed of a transparent conductive material such as an ITO and entirely covers an area in which pixel electrodes 560 are to be formed which will be described later. An alignment layer 557 is arranged so as to cover a surface of the electrode 556 remote from the pixel electrode 560.

An insulating film 558 is formed on a surface of the counter substrate 551 which faces the color filter 500. On the insulating film 558, scanning lines 561 and signal lines 562 are arranged so as to intersect with each other. Pixel electrodes 560 are formed in areas surrounded by the scanning lines 561 and the signal lines 562. Note that an alignment layer (not shown) is arranged on the pixel electrodes 560 in an actual liquid crystal display apparatus.

Thin-film transistors 563 each of which includes a source electrode, a drain electrode, a semiconductor layer, and a gate electrode are incorporated in areas surrounded by notch portions of the pixel electrodes 560, the scanning lines 561, and the signal lines 562. When signals are supplied to the scanning lines 561 and the signal lines 562, the thin-film transistors 563 are turned on or off so that power supply to the pixel electrodes 560 is controlled.

Note that although each of the display apparatuses 520, 530, and 550 is configured as a transmissive liquid crystal display apparatus, each of the display apparatuses 520, 530, and 550 may be configured as a reflective liquid crystal display apparatus having a reflective layer or a semi-transmissive liquid crystal display apparatus having a semi-transmissive reflective layer.

Figure 16:
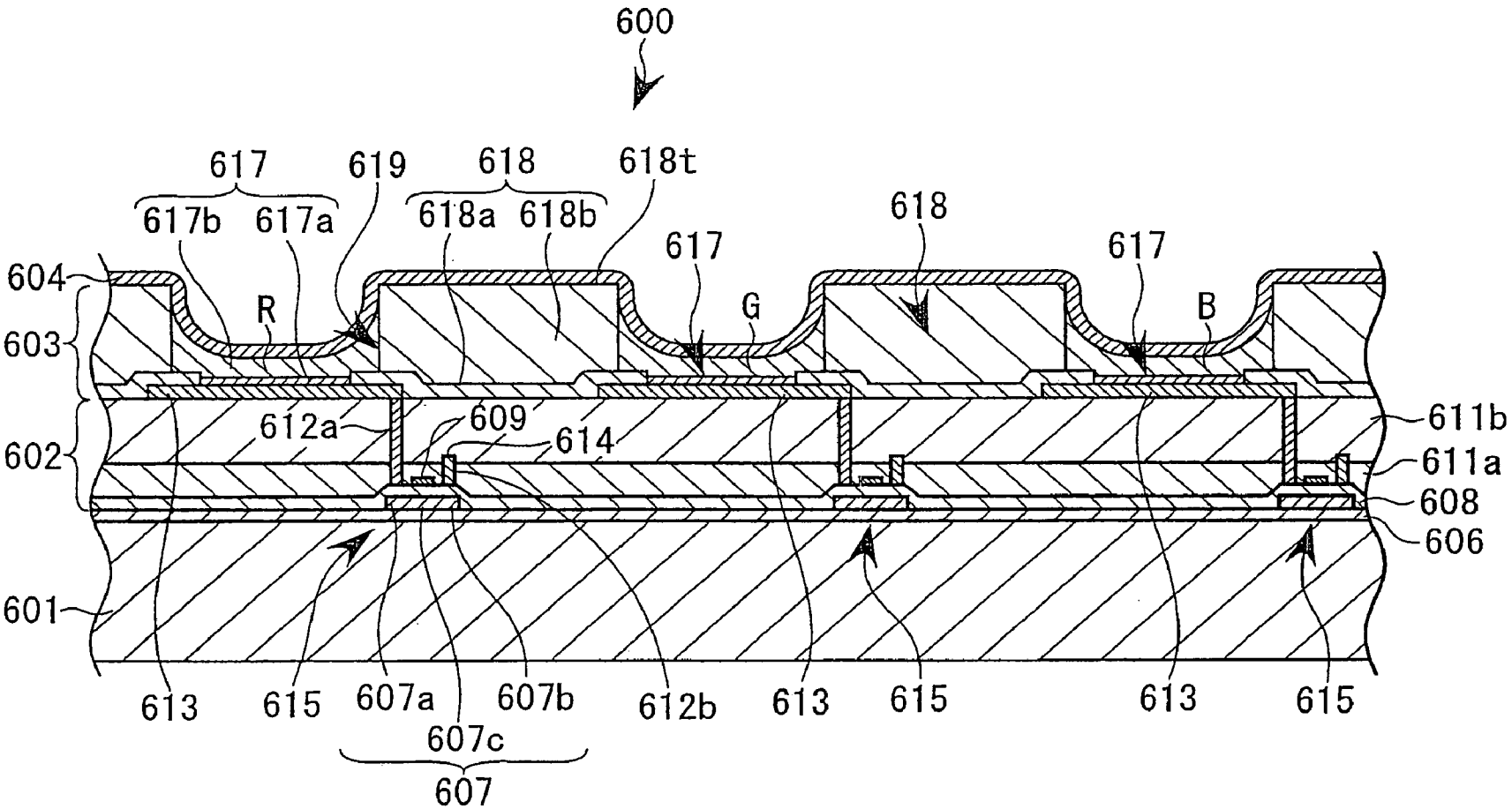
FIG. 16 is a sectional view illustrating an essential part of a display apparatus as an organic EL display apparatus.

FIG. 16 is a sectional view illustrating an essential part of a display area of an organic EL apparatus (hereinafter simply referred to as a display apparatus 600).

In this display apparatus 600, a circuit element portion 602, a light-emitting element portion 603, and a cathode 604 are laminated on a substrate (W) 601.

In this display apparatus 600, light is emitted from the light-emitting element portion 603 through the circuit element portion 602 toward the substrate 601 and eventually is emitted to an observer side. In addition, light emitted from the light-emitting element portion 603 toward an opposite side of the substrate 601 is reflected by the cathode 604, and thereafter passes through the circuit element portion 602 and the substrate 601 to be emitted to the observer side.

An underlayer protective film 606 formed of a silicon oxide film is arranged between the circuit element portion 602 and the substrate 601. Semiconductor films 607 formed of polysilicon oxide films are formed on the underlayer protective film 606 (near the light-emitting element portion 603) in an isolated manner. In each of the semiconductor films 607, a source region 607*a* and a drain region 607*b* are formed on the left and right sides thereof, respectively, by high-concentration positive-ion implantation. The center portion of each of the semiconductor films 607 which is not subjected to high-concentration positive-ion implantation serves as a channel region 607*c*.

In the circuit element portion 602, the underlayer protective film 606 and a transparent gate insulating film 608 covering the semiconductor films 607 are formed. Gate electrodes 609 formed of, for example, Al, Mo, Ta, Ti, or W are disposed on the gate insulating film 608 so as to correspond to the channel regions 607*c* of the semiconductor films 607. A first transparent interlayer insulating film 611*a* and a second transparent interlayer insulating film 611*b* are formed on the gate electrodes 609 and the gate insulating film 608. Contact holes 612*a* and 612*b* are formed so as to penetrate the first interlayer insulating film 611*a* and the second interlayer insulating film 611*b* and to be connected to the source region 607*a* and the drain region 607*b* of the semiconductor films 607.

Pixel electrodes 613 which are formed of ITOs, for example, and which are patterned to have a predetermined shape are formed on the second interlayer insulating film 611*b*. The pixel electrode 613 is connected to the source region 607*a* through the contact holes 612*a*.

Power source lines 614 are arranged on the first interlayer insulating film 611*a*. The power source lines 614 are connected through the contact holes 612*b* to the drain region 607*b*.

As shown in FIG. 16, the circuit element portion 602 includes thin-film transistors 615 connected to drive the respective pixel electrodes 613.

The light-emitting element portion 603 includes a functional layers 617 each formed on a corresponding one of pixel electrodes 613, and bank portions 618 which are formed between the pixel electrodes 613 and the functional layers 617 and which are used to partition the functional layers 617 from one another.

The pixel electrodes 613, the functional layers 617, and the cathode 604 formed on the functional layers 617 constitute the light-emitting element. Note that the pixel electrodes 613 are formed into a substantially rectangular shape in plan view by patterning, and the bank portions 618 are formed so that each two of the pixel electrodes 613 sandwich a corresponding one of the bank portions 618.

Each of the bank portions 618 includes an inorganic bank layer 618*a* (first bank layer) formed of an inorganic material such as SiO, $SiO_2$, or $TiO_2$, and an organic bank layer 618*b* (second bank layer) which is formed on the inorganic bank layer 618*a* and has a trapezoidal shape in a sectional view. The organic bank layer 618*b* is formed of a resist, such as an acrylic resin or a polyimide resin, which has an excellent heat resistance and an excellent lyophobic characteristic. A part of each of the bank portions 618 overlaps peripheries of corresponding two of the pixel electrodes 613 which sandwich each of the bank portions 618.

Openings 619 are formed between the bank portions 618 so as to gradually increase in size upwardly.

Each of the functional layers 617 includes a positive-hole injection/transport layer 617*a* formed so as to be laminated on the pixel electrodes 613 and a light-emitting layer 617*b* formed on the positive-hole injection/transport layer 617*a*. Note that another functional layer having another function may be arranged so as to be arranged adjacent to the light-emitting layer 617*b*. For example, an electronic transport layer may be formed.

The positive-hole injection/transport layer 617*a* transports positive holes from a corresponding one of the pixel electrodes 613 and injects the transported positive holes to the light-emitting layer 617*b*. The positive-hole injection/transport layer 617*a* is formed by ejection of a first composition (functional liquid) including a positive-hole injection/transport layer forming material. The positive-hole injection/transport layer forming material may be a known material.

The light-emitting layer 617*b* is used for emission of light having colors red (R), green (G), or blue (B), and is formed by ejection of a second composition (functional liquid) including a material for forming the light-emitting layer 617*b* (light-emitting material). As a solvent of the second composition (nonpolar solvent), a known material which is insoluble to the positive-hole injection/transport layer 617*a* is preferably used. Since such a nonpolar solvent is used as the second composition of the light-emitting layer 617*b*, the light-emitting layer 617*b* can be formed without dissolving the positive-hole injection/transport layer 617*a* again.

The light-emitting layer 617*b* is configured such that the positive holes injected from the positive-hole injection/transport layer 617*a* and electrons injected from the cathode 604 are recombined in the light-emitting layer 617*b* so as to emit light.

The cathode 604 is formed so as to cover an entire surface of the light-emitting element portion 603, and in combination with the pixel electrodes 613, supplies current to the functional layers 617. Note that a sealing member (not shown) is arranged on the cathode 604.

Steps of manufacturing the display apparatus 600 will now be described with reference to FIGS. 17 to 25.

Figure 17:
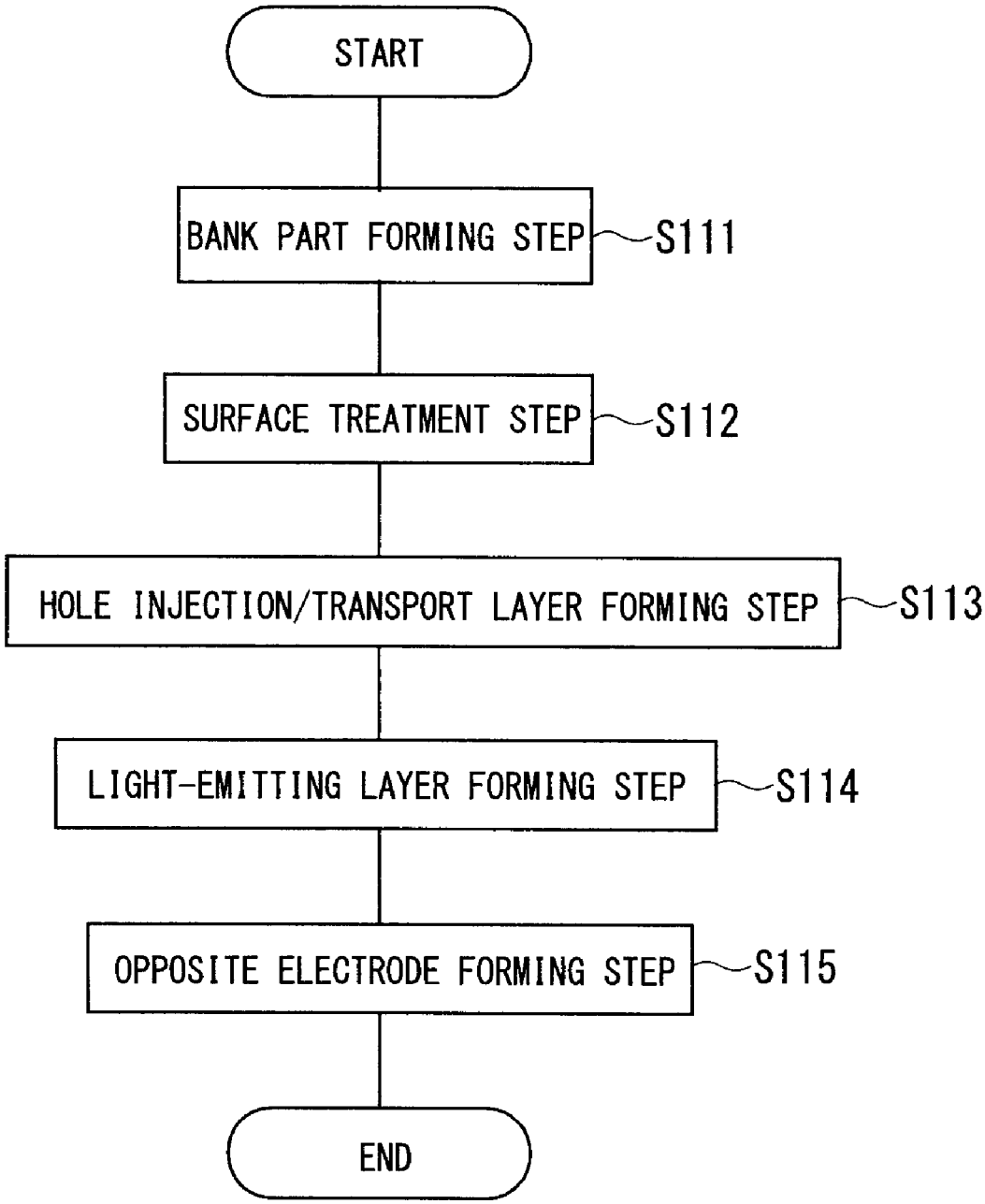
FIG. 17 is a flowchart illustrating manufacturing steps of the display apparatus as the organic EL display apparatus.

As shown in FIG. 17, the display apparatus 600 is manufactured through a bank portion forming step (Sill), a surface processing step (S112), a positive-hole injection/transport layer forming step (S113), a light-emitting layer forming step (S114), and a counter electrode forming step (S115). Note that the manufacturing steps are not limited to these examples shown, and one of these steps may be eliminated or another step may be added according to need.

Figure 18:
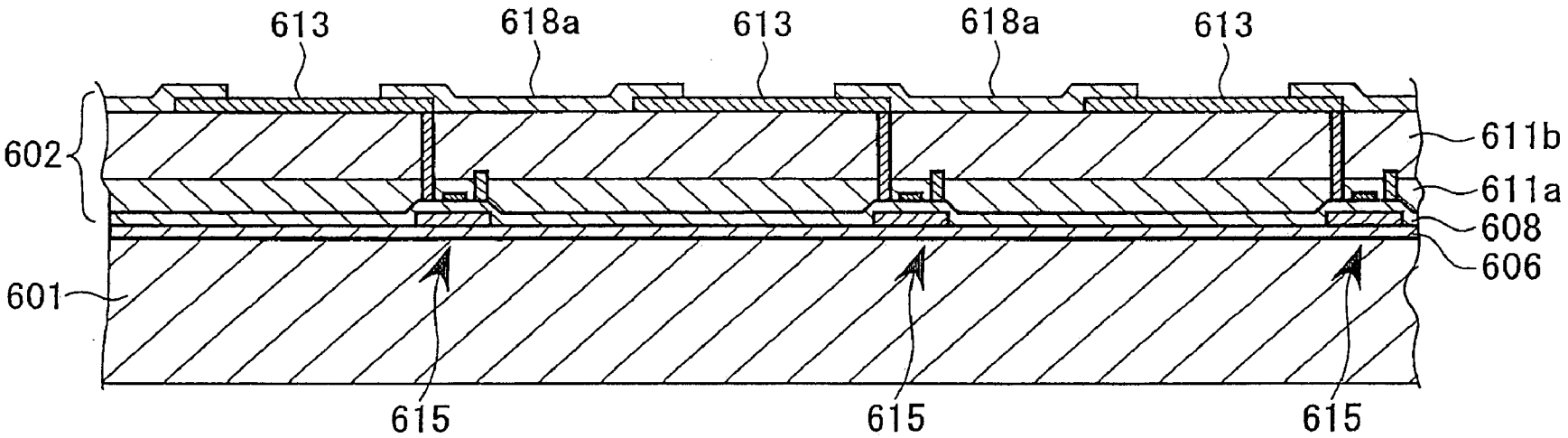
FIG. 18 is a process chart illustrating formation of an inorganic bank layer.

In the bank portion forming step (S111), as shown in FIG. 18, the inorganic bank layers 618*a* are formed on the second interlayer insulating film 611*b*. The inorganic bank layers 618*a* are formed by forming an inorganic film at a desired position and by patterning the inorganic film by the photolithography technique. At this time, a part of each of the inorganic bank layers 618*a* overlaps peripheries of corresponding two of the pixel electrodes 613 which sandwich each of the inorganic bank layers 618*a*.

Figure 19:
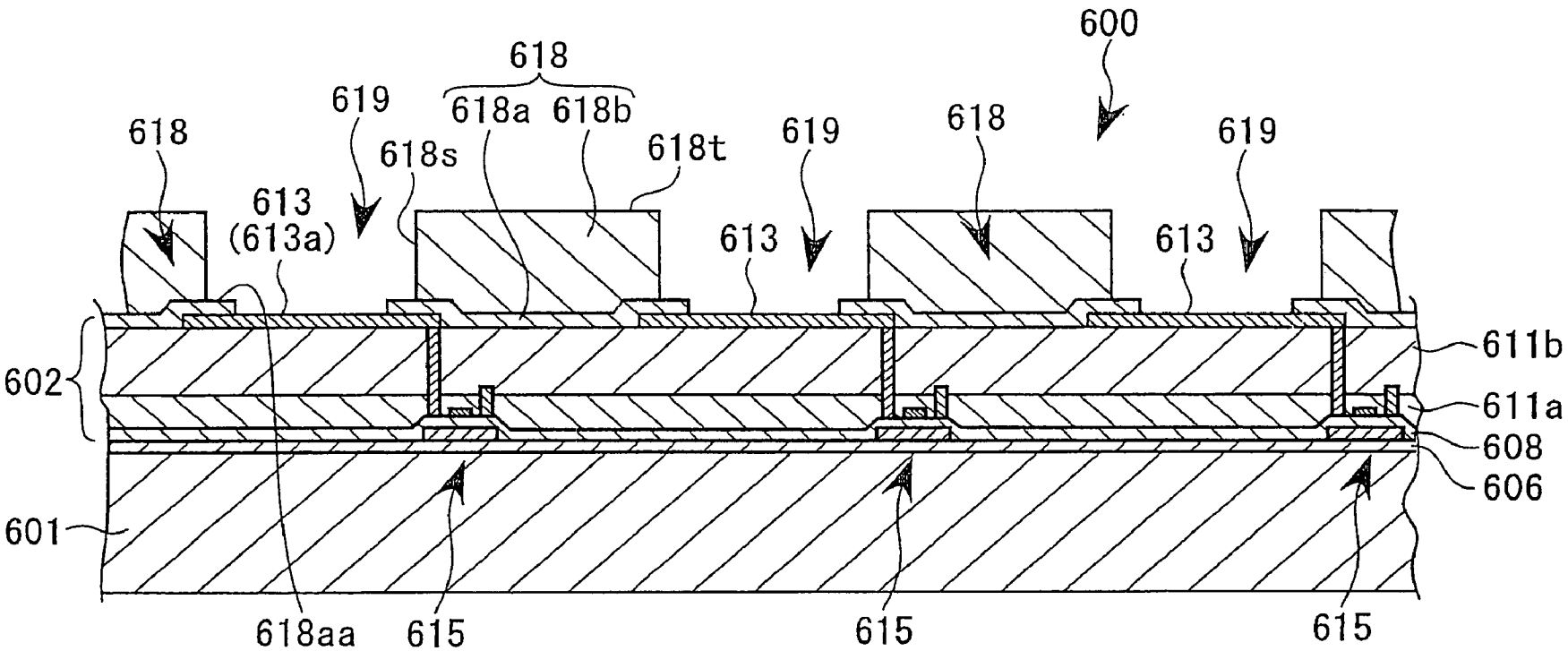
FIG. 19 is a process chart illustrating formation of the organic bank layer.

After the inorganic bank layers 618*a* are formed, as shown in FIG. 19, the organic bank layers 618*b* are formed on the inorganic bank layers 618*a*. As with the inorganic bank layers 618*a*, the organic bank layers 618*b* are formed by patterning a formed organic film by the photolithography technique.

The bank portions 618 are thus formed. When the bank portions 618 are formed, the openings 619 opening upward relative to the pixel electrodes 613 are formed between the bank portions 618. The openings 619 define pixel areas.

In the surface processing step (S112), a hydrophilic treatment and a repellency treatment are performed. The hydrophilic treatment is performed on first lamination areas 618*aa* of the inorganic bank layers 618*a* and electrode surfaces 613*a* of the pixel electrodes 613. The hydrophilic treatment is performed, for example, by plasma processing using oxide as a processing gas on surfaces of the first lamination areas 618*aa* and the electrode surfaces 613*a* to have hydrophilic properties. By performing the plasma processing, the ITO forming the pixel electrodes 613 is cleaned.

The repellency treatment is performed on walls 618*s* of the organic bank layers 618*b* and upper surfaces 618*t* of the organic bank layers 618*b*. The repellency treatment is performed as a fluorination treatment, for example, by plasma processing using tetrafluoromethane as a processing gas on the walls 618*s* and the upper surfaces 618*t*.

By performing this surface processing step, when the functional layers 617 is formed using the functional liquid droplet ejection heads 17, the functional liquid droplets are ejected onto the pixel areas with high accuracy. Furthermore, the functional liquid droplets attached onto the pixel areas are prevented from flowing out of the openings 619.

A display apparatus body 600A is obtained through these steps. The display apparatus body 600A is mounted on the set table 21 of the liquid droplet ejection apparatus 1 shown in FIG. 1 and the positive-hole injection/transport layer forming step (S113) and the light-emitting layer forming step (S114) are performed thereon.

Figure 20:
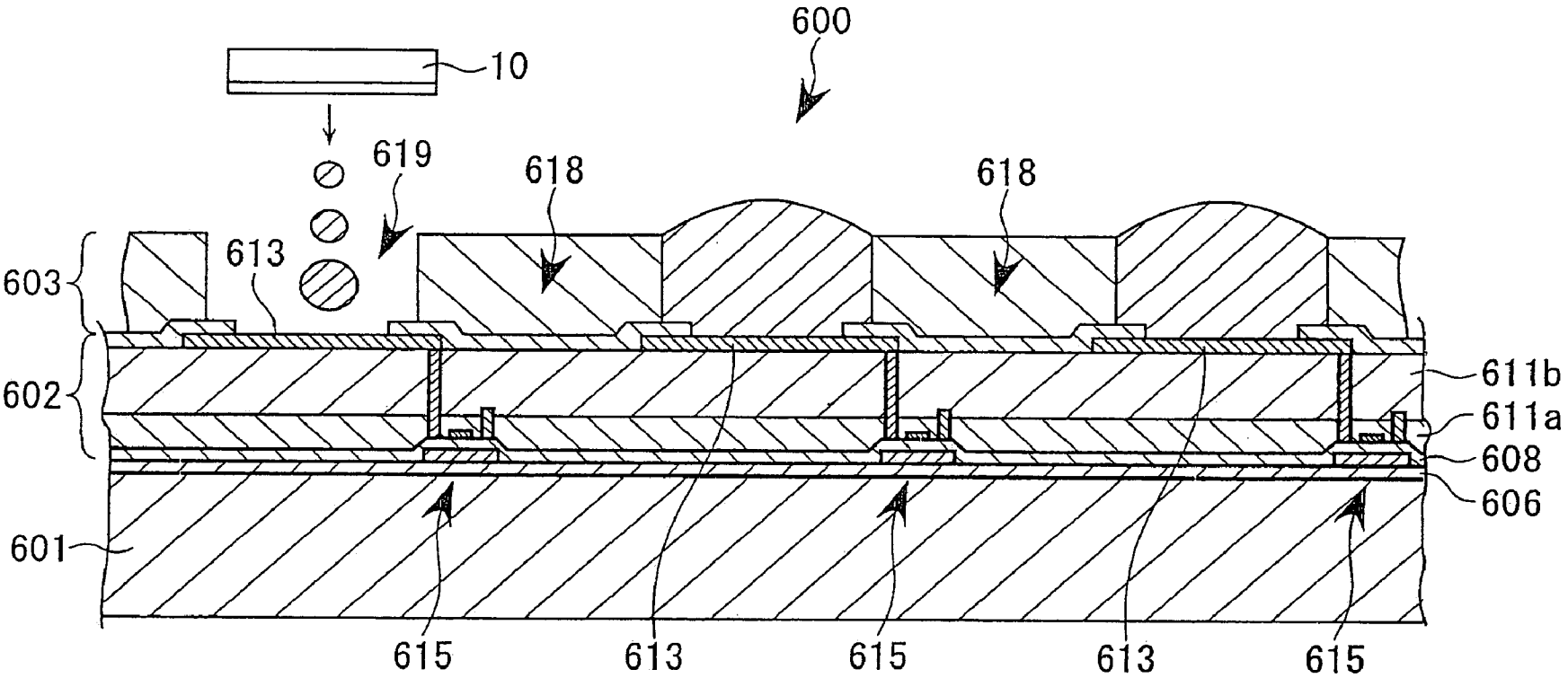
FIG. 20 is a process chart illustrating processes of forming a positive-hole injection/transport layer.
Figure 21:
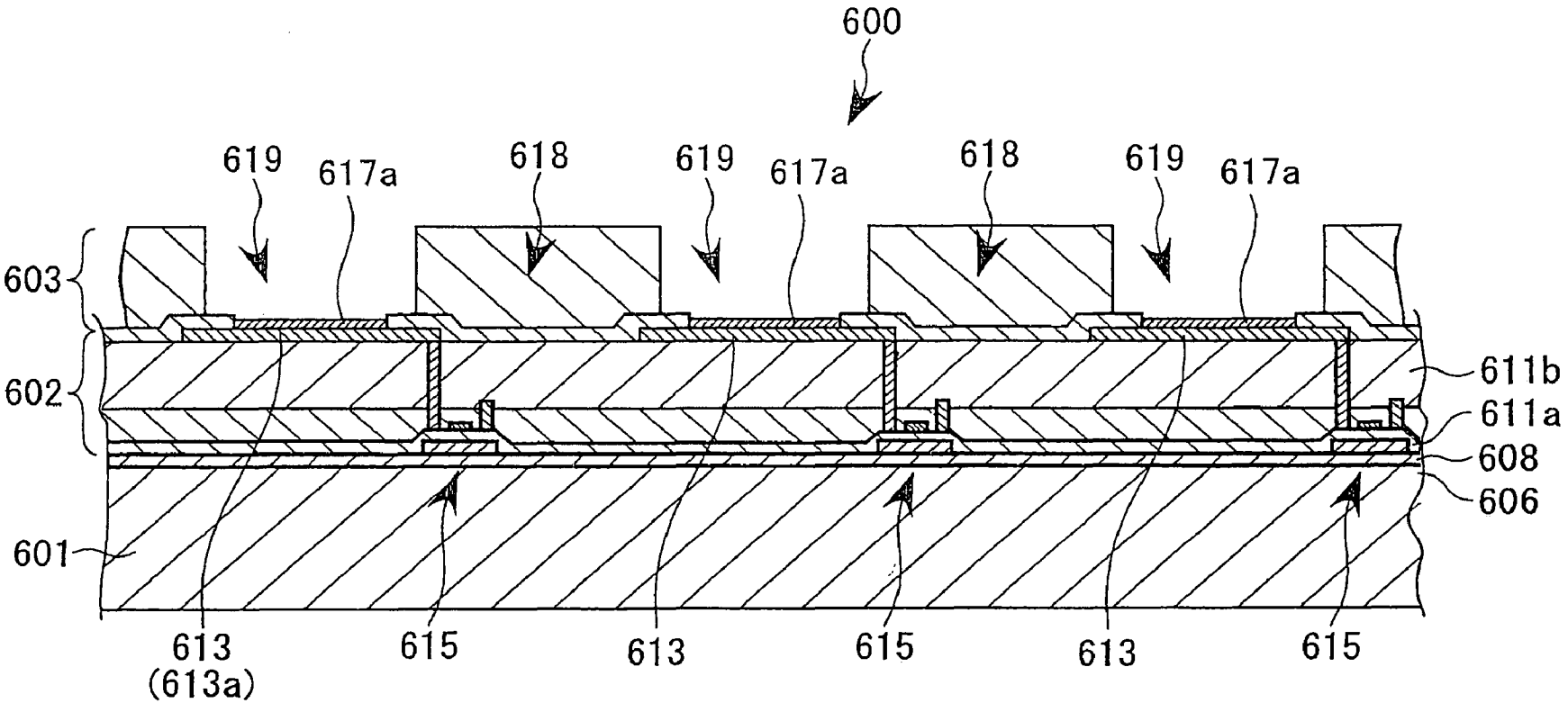
FIG. 21 is a process chart illustrating a state where the positive-hole injection/transport layer has been formed.

As shown in FIG. 20, in the positive-hole injection/transport layer forming step (S113), the first compositions including the material for forming a positive-hole injection/transport layer are ejected from the functional liquid droplet ejection heads 17 into the openings 619 included in the pixel areas. Thereafter, as shown in FIG. 21, drying processing and a thermal treatment are performed to evaporate polar solution included in the first composition whereby the positive-hole injection/transport layers 617*a* are formed on the pixel electrodes 613 (electrode surface 613*a*).

The light-emitting layer forming step (S114) will now be described. In the light-emitting layer forming step, as described above, a nonpolar solvent which is insoluble to the positive-hole injection/transport layers 617*a* is used as the solvent of the second composition used at the time of forming the light-emitting layer in order to prevent the positive-hole injection/transport layers 617*a* from being dissolved again.

On the other hand, since each of the positive-hole injection/transport layers 617*a* has low affinity to a nonpolar solvent, even when the second composition including the nonpolar solvent is ejected onto the positive-hole injection/transport layers 617*a*, the positive-hole injection/transport layers 617*a* may not be brought into tight contact with the light-emitting layers 617*b* or the light-emitting layers 617*b* may not be uniformly applied.

Accordingly, before the light-emitting layers 617*b* are formed, surface processing (surface improvement processing) is preferably performed so that each of the positive-hole injection/transport layers 617*a* has high affinity to the nonpolar solvent and to the material for forming the light-emitting layers. The surface processing is performed by applying a solvent the same as or similar to the nonpolar solvent of the second composition used at the time of forming the light-emitting layers on the positive-hole injection/transport layers 617*a* and by drying the applied solvent.

Employment of this surface processing allows the surface of the positive-hole injection/transport layers 617*a* to have high affinity to the nonpolar solvent, and therefore, the second composition including the material for forming the light-emitting layers can be uniformly applied to the positive-hole injection/transport layers 617*a* in the subsequent step.

Figure 22:
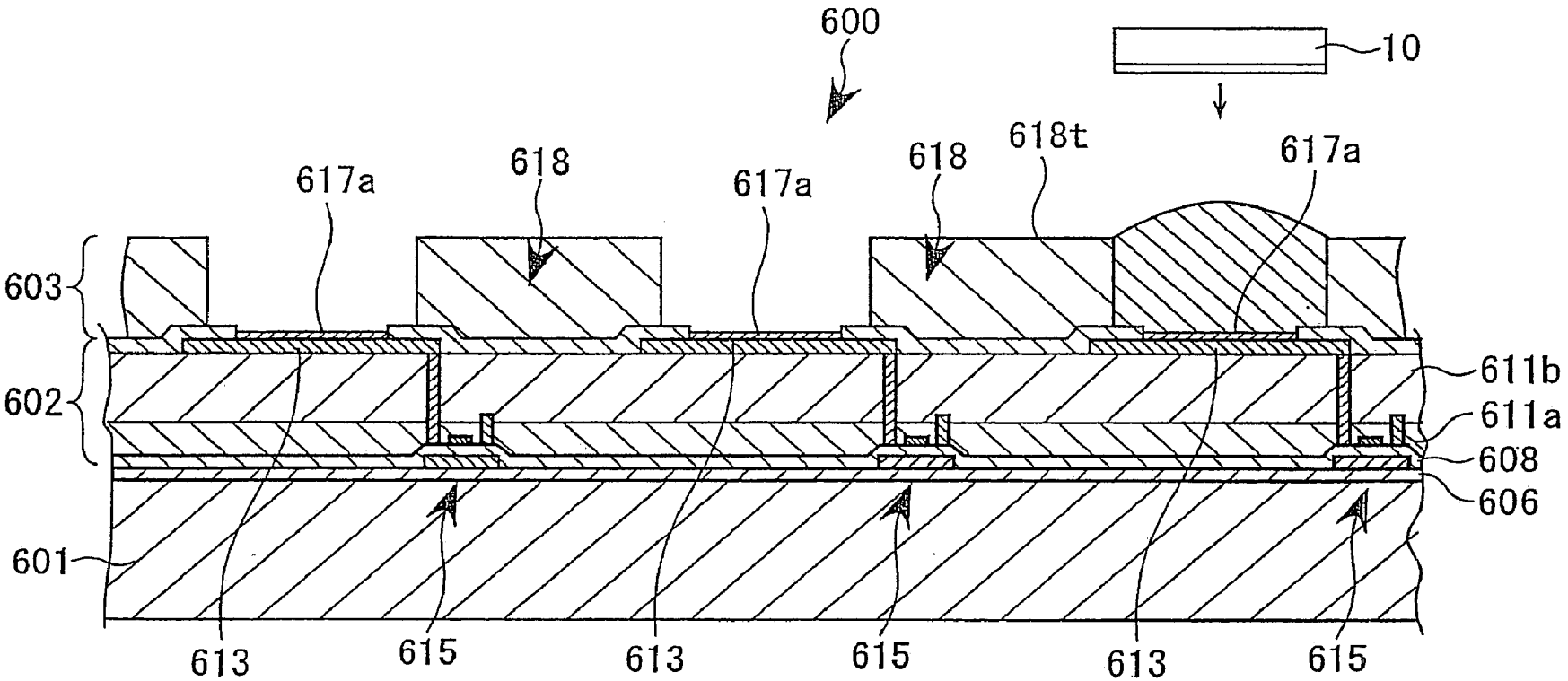
FIG. 22 is a process chart illustrating processes for forming a light-emitting layer having a blue color component.

As shown in FIG. 22, a predetermined amount of second composition including the material for forming the light-emission layers of one of the three colors (blue color (B) in an example of FIG. 22) is ejected into the pixel areas (openings 619) as functional liquid. The second composition ejected into the pixel areas spreads over the positive-hole injection/transport layer 617*a* and fills the openings 619. Note that, even if the second composition is ejected and attached to the upper surfaces 618*t* of the bank portions 618 which are outside of the pixel area, since the repellency treatment has been performed on the upper surfaces 618*t* as described above, the second component easily drops into the openings 619.

Figure 23:
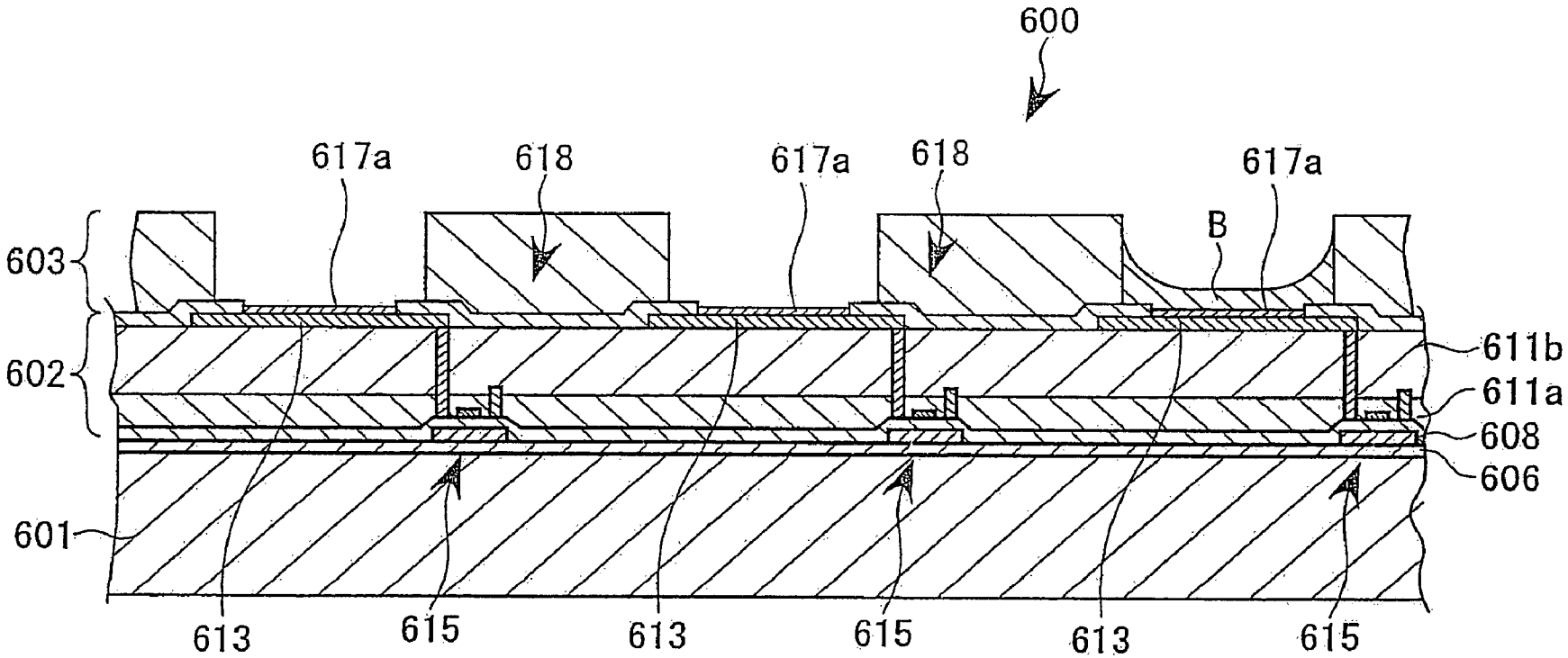
FIG. 23 is a process chart illustrating a state where the light-emitting layer having a blue color component has been formed.

Thereafter, the drying processing is performed so that the ejected second composition is dried and the nonpolar solvent included in the second composition is evaporated whereby the light-emitting layers 617*b* are formed on the positive-hole injection/transport layers 617*a* as shown in FIG. 23. In FIG. 23, one of the light-emitting layers 617*b* corresponding to the blue color (B) is formed.

Figure 24:
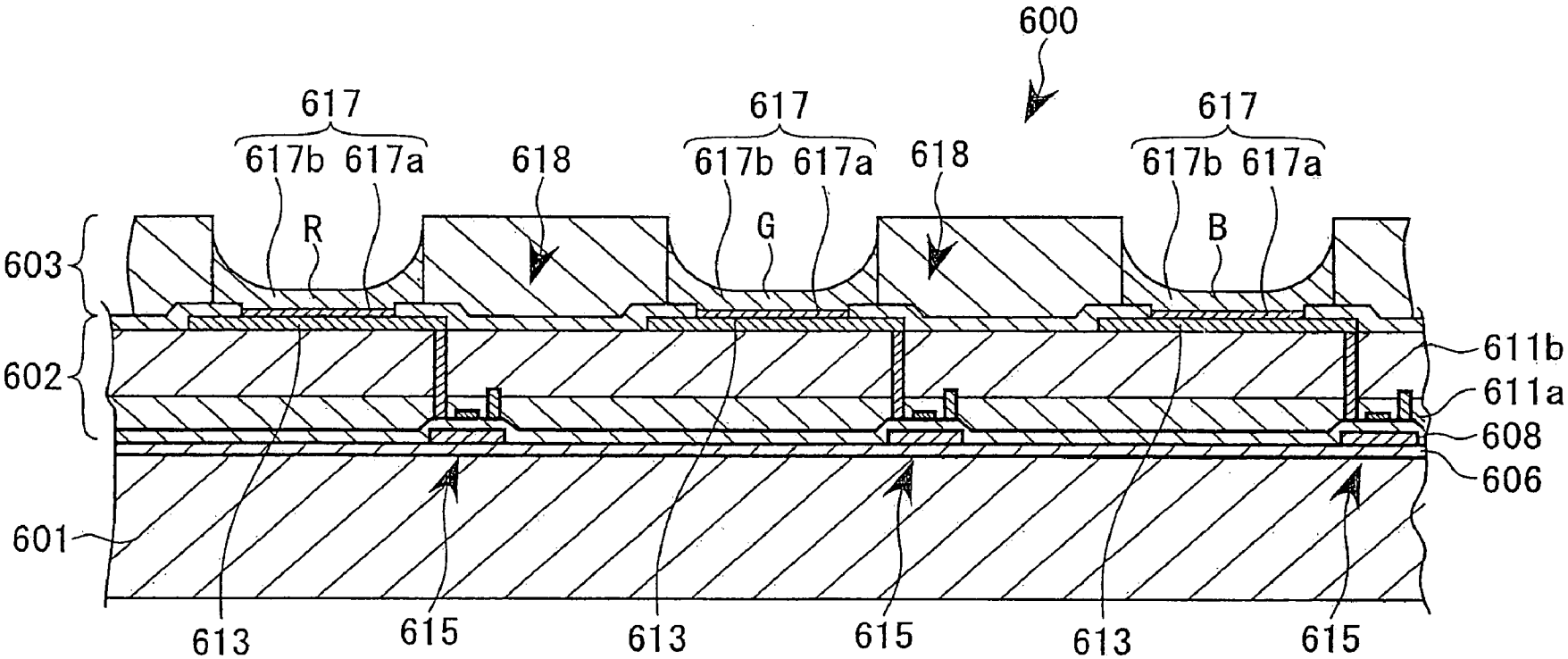
FIG. 24 is a process chart illustrating a state where light-emitting layers having three color components have been formed.

Similarly, by using the functional liquid droplet ejection heads 17, as shown in FIG. 24, a step similar to the above-described step of forming the light-emitting layers 617*b* corresponding to the blue color (B) is repeatedly performed so that the light-emitting layers 617*b* corresponding to other colors (red (R) and green (G)) are formed. Note that the order of formation of the light-emitting layers 617*b* is not limited to the order described above as an example, and any other orders may be applicable. For example, an order of forming the light-emitting layers 617*b* may be determined in accordance with a light-emitting layer forming material. Furthermore, the color scheme pattern of the three colors R, G, and B may be the tripe arrangement, the mosaic arrangement, or the delta arrangement.

As described above, the functional layers 617, that is, the positive-hole injection/transport layers 617*a* and the light-emitting layers 617*b* are formed on the pixel electrodes 613. Then, the process proceeds to the counter electrode forming step (S115).

Figure 25:
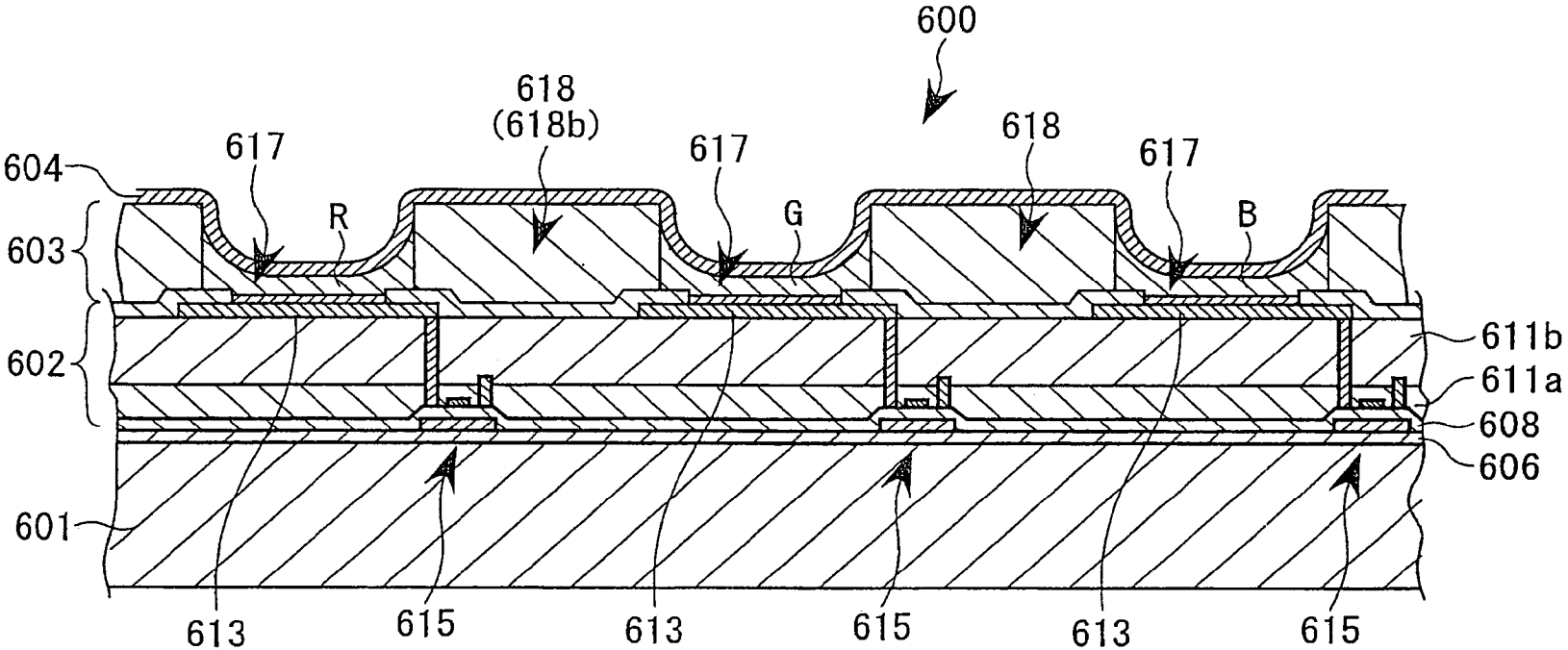
FIG. 25 is a process chart illustrating processes for forming a cathode.

In the counter electrode forming step (S115), as shown in FIG. 25, the cathode (counter electrode) 604 is formed on entire surfaces of the light-emitting layers 617*b* and the organic bank layers 618*b* by an evaporation method, sputtering, or a CVD (chemical vapor deposition) method, for example. The cathode 604 is formed by laminating a calcium layer and an aluminum layer, for example, in this embodiment.

An Al film and an Ag film as electrodes and a protective layer formed of $SiO_2$ or SiN for preventing the Al film and the Ag film from being oxidized are formed on the cathode 604.

After the cathode 604 is thus formed, other processes such as sealing processing of sealing a top surface of the cathode 604 with a sealing member and wiring processing are performed whereby the display apparatus 600 is obtained.

Figure 26:
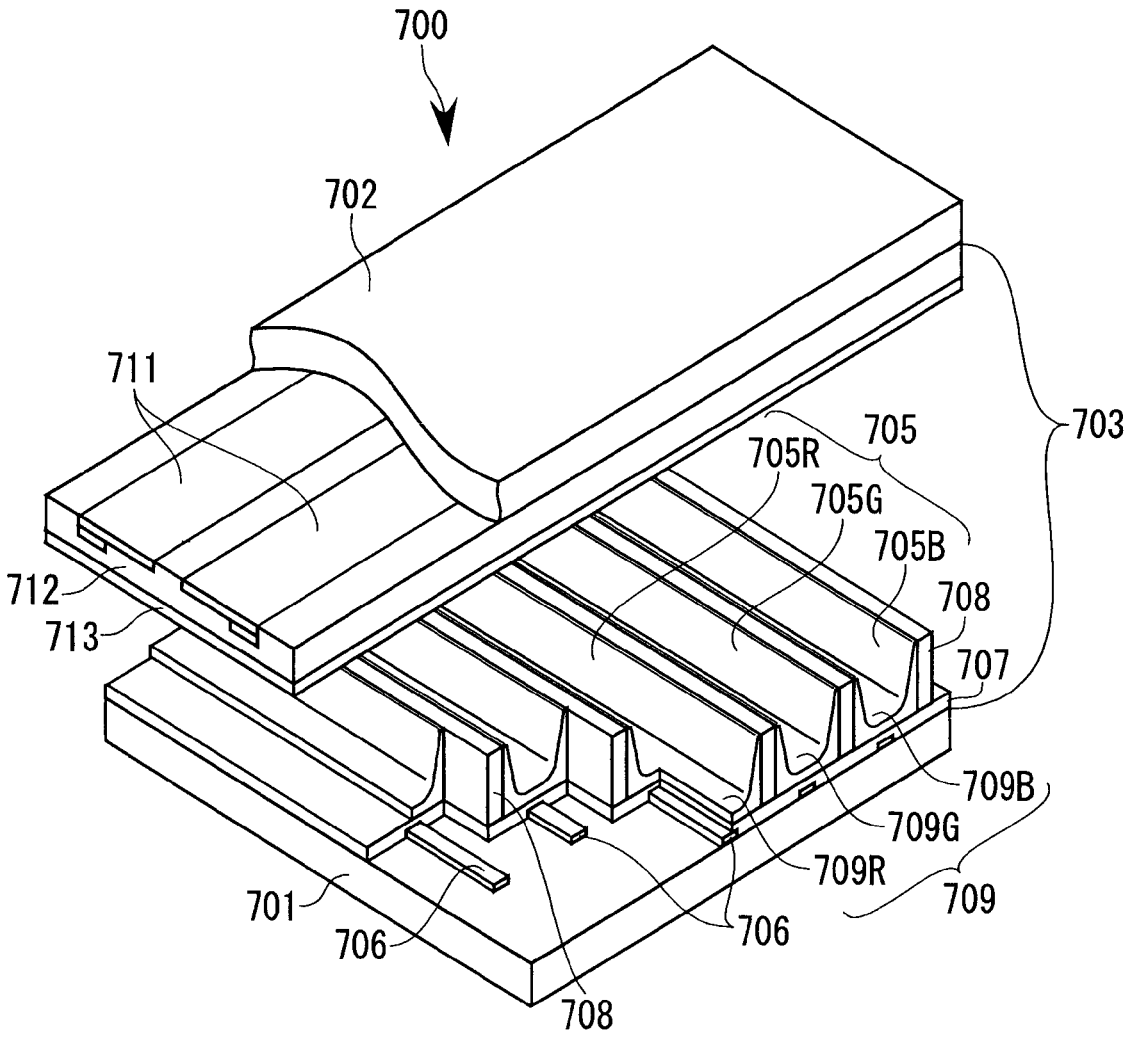
FIG. 26 is a perspective view illustrating an essential part of a plasma display apparatus (PDP apparatus).

FIG. 26 is an exploded perspective view of an essential part of a plasma display apparatus (PDP apparatus: hereinafter simply referred to as a display apparatus 700). Note that, in FIG. 26, the display apparatus 700 is partly cut away.

The display apparatus 700 includes a first substrate 701, a second substrate 702 which faces the first substrate 701, and a discharge display portion 703 interposed therebetween. The discharge display portion 703 includes a plurality of discharge chambers 705. The discharge chambers 705 include red discharge chambers 705R, green discharge chambers 705G, and blue discharge chambers 705B, and are arranged so that one of the red discharge chambers 705R, one of the green discharge chambers 705G, and one of the blue discharge chambers 705B constitute one pixel as a group.

Address electrodes 706 are arranged on the first substrate 701 with predetermined intervals therebetween in a stripe pattern, and a dielectric layer 707 is formed so as to cover top surfaces of the address electrodes 706 and the first substrate 701. Partition walls 708 are arranged on the dielectric layer 707 so as to be arranged along with the address electrodes 706 in a standing manner between the adjacent address electrodes 706. Some of the partition walls 708 extend in a width direction of the address electrodes 706 as shown in FIG. 26, and the others (not shown) extend perpendicular to the address electrodes 706.

Regions partitioned by the partition walls 708 serve as the discharge chambers 705.

The discharge chambers 705 include respective fluorescent substances 709. Each of the fluorescent substances 709 emits light having one of the colors of red (R), green (G) and blue (B). The red discharge chamber 705R has a red fluorescent substance 709R on its bottom surface, the green discharge chamber 705G has a green fluorescent substance 709G on its bottom surface, and the blue discharge chamber 705B has a blue fluorescent substance 709B on its bottom surface.

A plurality of display electrodes 711 are formed with predetermined intervals therebetween in a stripe manner in a direction perpendicular to the address electrodes 706. A dielectric layer 712 and a protective film 713 formed of MgO, for example, are formed so as to cover the display electrodes 711.

The first substrate 701 and the second substrate 702 are attached so that the address electrodes 706 are arranged perpendicular to the display electrodes 711. Note that the address electrodes 706 and the display electrodes 711 are connected to an alternate power source (not shown).

When the address electrodes 706 and the display electrodes 711 are brought into conduction states, the fluorescent substances 709 are excited and emit light whereby display with colors is achieved.

In this embodiment, the address electrodes 706, the display electrodes 711, and the fluorescent substances 709 may be formed using the liquid droplet ejection apparatus 1 shown in FIG. 1. Steps of forming the address electrodes 706 on the first substrate 701 are described hereinafter.

The steps are performed in a state where the first substrate 701 is mounted on the set table 21 on the liquid droplet ejection apparatus 1.

The functional liquid droplet ejection heads 17 eject a liquid material (functional liquid) including a material for forming a conducting film wiring as functional droplets to be attached onto regions for forming the address electrodes 706. The material for forming a conducting film wiring included in the liquid material is formed by dispersing conductive fine particles such as those of a metal into dispersed media. Examples of the conductive fine particles include a metal fine particle including gold, silver, copper, palladium, or nickel, and a conductive polymer.

When ejection of the liquid material onto all the desired regions for forming the address electrodes 706 is completed, the ejected liquid material is dried, and the disperse media included in the liquid material is evaporated whereby the address electrodes 706 are formed.

Although the steps of forming the address electrodes 706 are described as an example above, the display electrodes 711 and the fluorescent substances 709 may be formed by the steps described above.

In a case where the display electrodes 711 are formed, as with the address electrodes 706, a liquid material (functional liquid) including a material for forming a conducting film wiring is ejected from the functional liquid droplet ejection heads 17 as liquid droplets to be attached to the areas for forming the display electrodes.

In a case where the fluorescent substances 709 are formed, a liquid material including fluorescent materials corresponding to three colors (R, G, and B) is ejected as liquid droplets from the functional liquid droplet ejection heads 17 so that liquid droplets having the three colors (R, G, and B) are attached within the discharge chambers 705.

Figure 27:
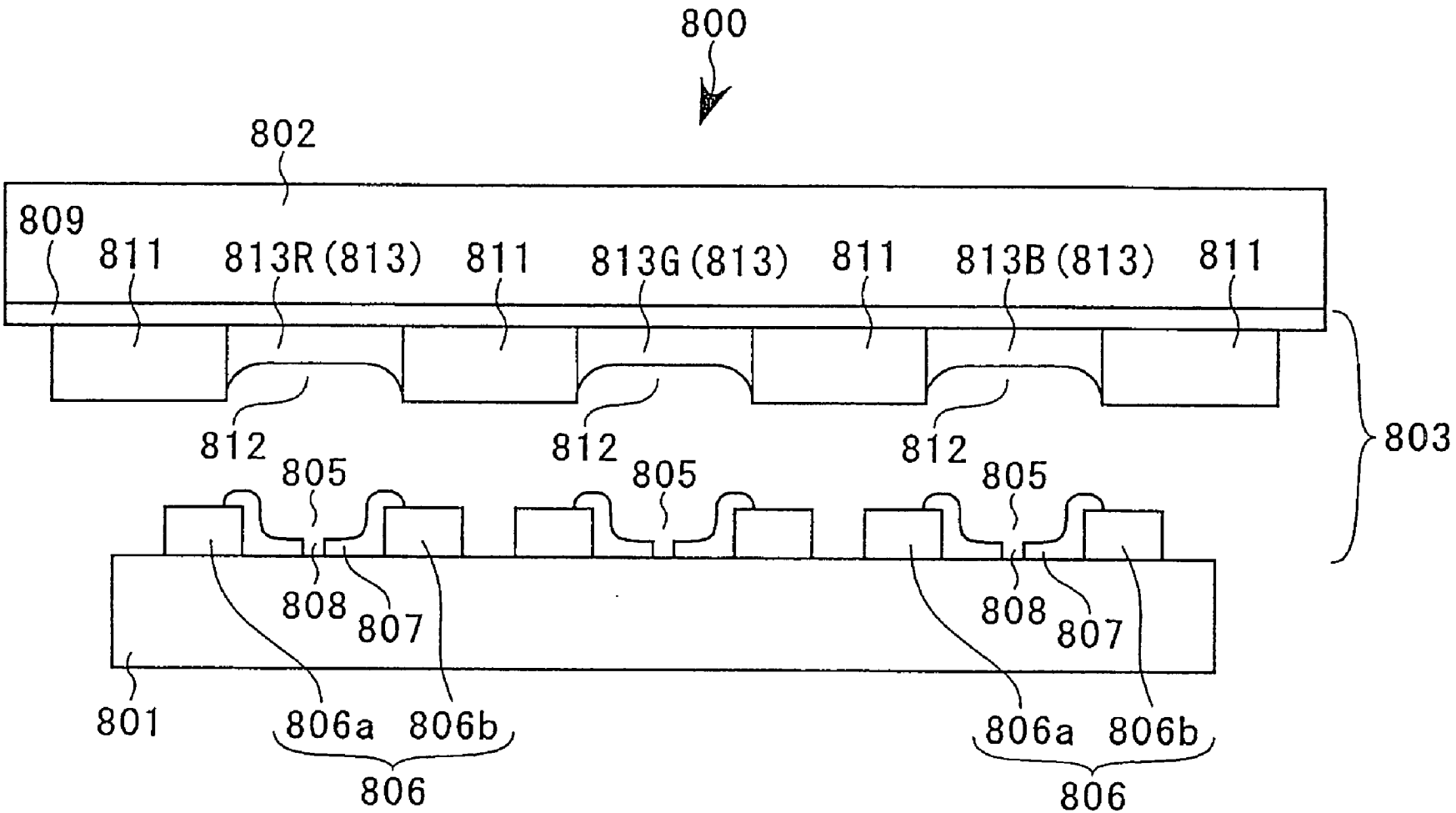
FIG. 27 is a sectional view illustrating an essential part of an electron emission display apparatus (FED apparatus).

FIG. 27 shows a sectional view of an essential part of an electron emission apparatus (also referred to as a FED apparatus or a SED apparatus: hereinafter simply referred to as a display apparatus 800). In FIG. 27, a part of the display apparatus 800 is shown in the sectional view.

The display apparatus 800 includes a first substrate 801, a second substrate 802 which faces the first substrate 801, and a field-emission display portion 803 interposed therebetween. The field-emission display portion 803 includes a plurality of electron emission portions 805 arranged in a matrix.

First element electrodes 806*a* and second element electrodes 806*b*, and conductive films 807 are arranged on the first substrate 801. The first element electrodes 806*a* and the second element electrodes 806*b* intersect with each other. Cathode electrodes 806 are formed on the first substrate 801, and each of the cathode electrodes 806 is constituted by one of the first element electrodes 806*a* and one of the second element electrodes 806*b*. In each of the cathode electrodes 806, one of the conductive films 807 having a gap 808 is formed in a portion formed by the first element electrode 806*a* and the second element electrode 806*b*. That is, the first element electrodes 806*a*, the second element electrodes 806*b*, and the conductive films 807 constitute the plurality of electron emission portions 805. Each of the conductive films 807 is constituted by palladium oxide (PdO). In each of the cathode electrodes 806, the gap 808 is formed by forming processing after the corresponding one of the conductive films 807 is formed.

An anode electrode 809 is formed on a lower surface of the second substrate 802 so as to face the cathode electrodes 806. A bank portion 811 is formed on a lower surface of the anode electrode 809 in a lattice. Fluorescent materials 813 are arranged in opening portions 812 which opens downward and which are surrounded by the bank portion 811. The fluorescent materials 813 correspond to the electron emission portions 805. Each of the fluorescent materials 813 emits fluorescent light having one of the three colors, red (R), green (G), and blue (B). Red fluorescent materials 813R, green fluorescent materials 813G, and blue fluorescent materials 813B are arranged in the opening portions 812 in a predetermined arrangement pattern described above.

The first substrate 801 and the second substrate 802 thus configured are attached with each other with a small gap therebetween. In this display apparatus 800, electrons emitted from the first element electrodes 806*a* or the second element electrodes 806*b* included in the cathode electrodes 806 hit the fluorescent materials 813 formed on the anode electrode 809 so that the fluorescent materials 813 are excited and emit light whereby display with colors is achieved.

As with the other embodiments, in this case also, the first element electrodes 806*a*, the second element electrodes 806*b*, the conductive films 807, and the anode electrode 809 may be formed using the liquid droplet ejection apparatus 1. In addition, the red fluorescent materials 813R, the green fluorescent materials 813G, and the blue fluorescent materials 813B may be formed using the liquid droplet ejection apparatus 1.

Figure 28A:
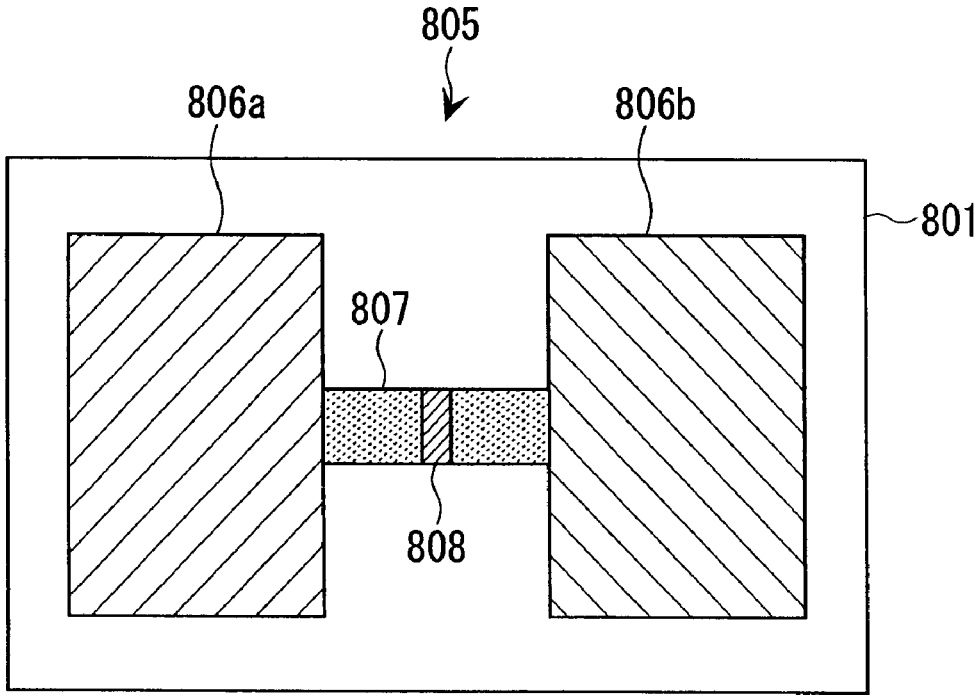
FIG. 28A is a plan view illustrating an electron emission portion and the vicinity thereof of a display apparatus.
Figure 28B:
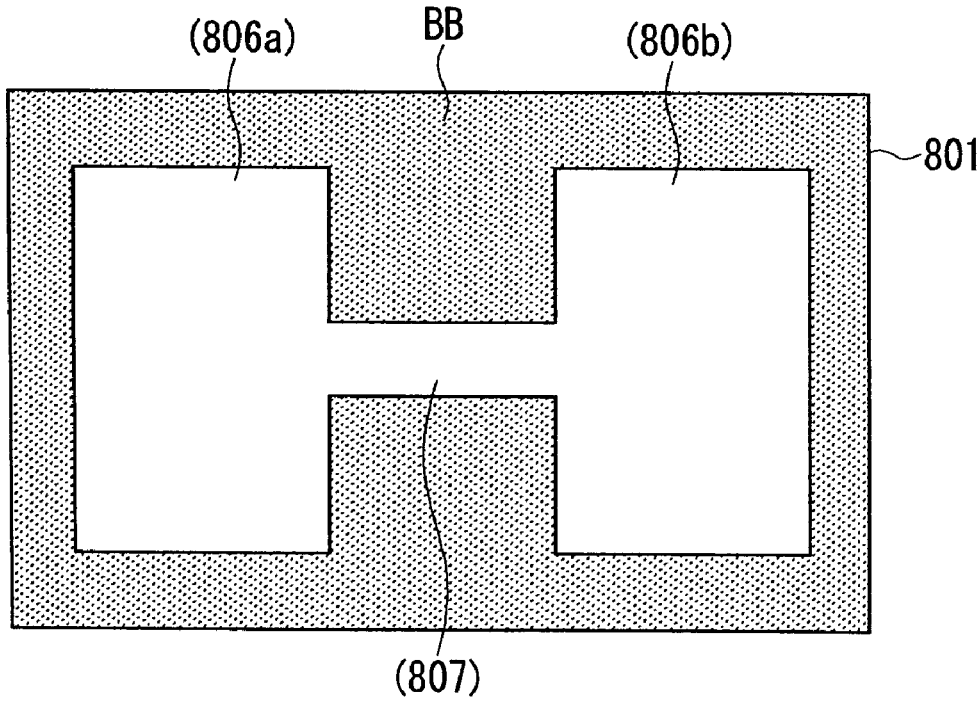
FIG. 28B is a plan view illustrating a method of forming the electron emission portion and the vicinity thereof.

Each of the first element electrodes 806*a*, each of the second element electrodes 806*b*, and each of the conductive films 807 have shapes as shown in FIG. 28A. When the first element electrodes 806*a*, the second element electrodes 806*b*, and the conductive films 807 are formed, portions for forming the first element electrodes 806*a*, the second element electrodes 806*b*, and the conductive films 807 are left as they are on the first substrate 801 and only bank portions BB are formed (by a photolithography method) as shown in FIG. 28B. Then, the first element electrodes 806*a* and the second element electrodes 806*b* are formed by an inkjet method using a solvent ejected from the liquid droplet ejection apparatus 1 in grooves defined by the bank portions BB and are formed by drying the solvent. Thereafter, the conductive films 807 are formed by the inkjet method using the liquid droplet ejection apparatus 1. After forming the conductive films 807, the bank portions BB are removed by ashing processing and the forming processing is performed. Note that, as with the case of the organic EL device, the hydrophilic treatment is preferably performed on the first substrate 801 and the second substrate 802 and the repellency treatment is preferably performed on the bank portion 811 and the bank portions BB.

Examples of other electro-optical apparatuses include an apparatus for forming metal wiring, an apparatus for forming a lens, an apparatus for forming a resist, and an apparatus for forming an optical diffusion body. Use of the liquid droplet ejection apparatus 1 makes it possible to efficiently manufacture various electro-optical apparatuses.

What is claimed is:

1. A landed dot measuring method in which a topology measuring apparatus having an interferometer measures topology of a landed dot which is a functional liquid droplet landed on an inspection sheet when an inspection ejection for a functional liquid droplet ejection head is performed including:

inspection-ejecting in which multiple ejection nozzles of a functional liquid droplet ejection head inspection-eject one by one at a given time interval while the functional liquid droplet ejection head is moved in a main scanning direction relatively with respect to the inspection sheet and, the multiple ejection nozzles being arranged to form a line in a sub scanning direction perpendicular to the main scanning direction; and measuring in which respective topologies of multiple landed dots are measured while the topology measuring apparatus follows the functional liquid droplet ejection head and moves in the main scanning direction and in the sub scanning direction at a same speed as the functional liquid droplet ejection head relatively with respect to the inspection sheet.

2. The landed dot measuring method according to claim 1, wherein it further includes volume measuring which measures volume of each of the landed dots based on a result of the topology measurement.

3. The landed dot measuring method according to claim 1, wherein it further includes position measuring which measures a positional offset amount from a designed value of each of the landed dots based on the result of the topology measurement.

4. A landed dot measuring apparatus in which a topology measuring apparatus having an interferometer measures topology of a landed dot which is a functional liquid droplet landed on an inspection sheet when an inspection ejection for a functional liquid droplet ejection head is performed comprising:

a head moving device which moves a functional liquid droplet ejection head in a main scanning direction relatively with respect to the inspection sheet;

the topology measuring apparatus which measures topology of the landed dot;

a moving device for the topology measuring apparatus which moves the topology measuring apparatus in the main scanning direction and a sub scanning direction perpendicular to the main scanning direction relatively with respect to the inspection sheet; and a controller which controls the functional liquid droplet ejection head, the head moving device, the topology measuring apparatus and the moving device for the topology measuring apparatus, the controller causing multiple ejection nozzles of the functional liquid droplet ejection head to inspection-eject one by one at a given time interval while moving the functional liquid droplet ejection head in the main scanning direction relatively, the multiple ejection nozzles being arranged to form a line in the sub scanning direction and measuring topologies of multiple landed dots while moving the topology measuring apparatus so as to follow the functional liquid droplet ejection head by relative movements in the main scanning direction and the sub scanning direction at a same speed as the functional liquid droplet ejection head.

5. The landed dot measuring apparatus according to claim 4, wherein the topology measuring apparatus measures volume of each of the landed dots based on a result of the topology measurement.

6. The landed dot measuring apparatus according to claim 4, wherein the topology measuring apparatus measures a positional offset amount from a designed value of each of the landed dots based on the result of the topology measurement.

7. A liquid droplet ejection apparatus comprising:

a landed dot measuring apparatus according to claim 4;

a head unit having a sub carriage in which a plurality of the functional liquid droplet ejection heads is mounted; and a plotting device which plots by ejecting functional liquid droplets from the plurality of the functional liquid droplet ejection heads while moving the head unit relatively with respect to a workpiece.

8. The liquid droplet ejection apparatus according to claim 7, wherein the head unit comprises a functional liquid droplet ejection head introducing a functional liquid of R color, a functional liquid droplet ejection head introducing a functional liquid of G color, and a functional liquid droplet ejection head introducing a functional liquid of B color.

9. A method of manufacturing an electro-optic apparatus wherein a film portion is formed with a functional liquid droplet on a workpiece using the liquid droplet ejection apparatus according to claim 7.

10. An electro-optic apparatus wherein a film portion is formed with a functional liquid droplet on a workpiece using the liquid droplet ejection apparatus according to claim 7.

11. An electro-optic apparatus manufactured by the method of manufacturing the electro-optic apparatus according to claim 9.

12. An electronic apparatus having the electro-optic apparatus according to claim 10.

* * * * *